US007984744B2

(12) United States Patent
Karasawa et al.

(10) Patent No.: US 7,984,744 B2
(45) Date of Patent: Jul. 26, 2011

(54) FOLDABLE SCREEN DEVICE

(75) Inventors: Shuuji Karasawa, Nerima-ku (JP); Yoji Kamosawa, Nerima-ku (JP); Masato Moriya, Nerima-ku (JP)

(73) Assignee: Seiki Hanbai Co., Ltd., Tokyo (JP)

( * ) Notice: Subject to any disclaimer, the term of this patent is extended or adjusted under 35 U.S.C. 154(b) by 422 days.

(21) Appl. No.: 12/094,274

(22) PCT Filed: Nov. 8, 2006

(86) PCT No.: PCT/JP2006/322291

§ 371 (c)(1),
(2), (4) Date: May 20, 2008

(87) PCT Pub. No.: WO2007/063685

PCT Pub. Date: Jun. 7, 2007

(65) Prior Publication Data

US 2009/0266495 A1 Oct. 29, 2009

(30) Foreign Application Priority Data

Nov. 30, 2005 (JP) ..... 2005-347210

(51) Int. Cl.
*E06B 3/94* (2006.01)

(52) U.S. Cl. ..... 160/84.06; 160/84.03

(58) Field of Classification Search ..... 160/84.06, 160/84.03, 84.04, 84.02, 84.01, 346, 190, 160/193; 16/87.6 R
See application file for complete search history.

(56) References Cited

U.S. PATENT DOCUMENTS

| | | | | |
|---|---|---|---|---|
| 4,868,935 | A * | 9/1989 | Van Weelden | 4/610 |
| 5,351,737 | A * | 10/1994 | Hoshiyama | 160/84.03 |
| 5,377,737 | A * | 1/1995 | Moriya et al. | 160/84.06 |
| 5,477,904 | A * | 12/1995 | Yang | 160/370.23 |
| 6,186,212 | B1 * | 2/2001 | Tsuchida | 160/84.06 |
| 6,318,438 | B1 * | 11/2001 | Uno et al. | 160/31 |
| 6,766,847 | B1 * | 7/2004 | Wang | 160/199 |
| 6,978,820 | B2 * | 12/2005 | Aoki | 160/84.06 |
| 2007/0029053 | A1 * | 2/2007 | Moriya et al. | 160/84.06 |

FOREIGN PATENT DOCUMENTS

| | | |
|---|---|---|
| JP | 61 14555 | 5/1986 |
| JP | 2000 160949 | 6/2000 |
| JP | 2003 161089 | 6/2003 |

* cited by examiner

*Primary Examiner* — David Purol
(74) *Attorney, Agent, or Firm* — Oblon, Spivak, McClelland, Maier & Neustadt, L.L.P.

(57) ABSTRACT

In a folding screen device pulled in the lateral direction, the widthwise dimension limit of the screen device in the opening and closing direction of the screen is eliminated. A plurality of screen units include movable vertical frame members attached to both ends of a screen expandable in an accordion manner. The vertical frame members are slidable along a lateral frame member of a building opening. Screen guides in the screen units move out and into the interior of the vertical frame member through upper and lower ends thereof in a bent state, and are led along upper and lower ends of the screen in an extended state. A parallel movement mechanism causes the vertical frame members to move in parallel during opening and closing of the screen. The screen units can be arranged in parallel in the building opening by connecting adjacent vertical frame members of the screen units.

7 Claims, 18 Drawing Sheets

FOLDABLE SCREEN DEVICE

TECHNICAL FIELD

The present invention relates to a folding screen device in which a screen expandable in an accordion manner can be opened and closed by pulling in the lateral direction for the purpose of insect screening, light shielding, hiding, heat insulation or the like.

BACKGROUND ART

In a folding screen device in which a screen expandable in an accordion manner can be opened and closed by pulling in the lateral direction, the one provided with a screen guide for guiding an end of the screen by moving out and into the interiors of the upper end and the lower end of at least one of frame members attached to both ends of the screen in a bent state and being led out along the end of the screen in the extended state is known by, for example, Patent Document 1.

Since the screen device of this type can avoid arrangement of a large member which guides the lower end of the screen on the lower side of an opening of a building in a screen-opened state in which the screen is completely folded and stored, it is simple in appearance and does not hinder passage of pedestrians, wheelchairs or the like, and hence it is quite effective in a point that it can adapt barrier-free structure.

Therefore, in the screen device of this type, it is necessary to configure the extended width of the screen guide within a range in which the screen can be led completely into the interior of the frame member in the screen-opened state in which the screen is completely folded and stored, and hence the widthwise dimension of the screen device in the direction of opening and closing the screen is limited and, in particular, in the case in which the opening of the building is wider than the height, the screen device may be difficult to mount.

In addition, even though the widthwise dimension of the product can be increased by any means, the distance of movement of the operating frame in association with the opening and closing operation of the screen is increased, and hence difficulties may be occurred during opening and closing operation, or the operation may take a lot of trouble.

Patent Document 1: Japanese Unexamined Patent Application Publication No. 2005-36518

DISCLOSURE OF INVENTION

Problems to be Solved by the Invention

It is a technical subject of the present invention to provide the folding screen device including a screen guide for guiding the upper end and the lower end of the screen by moving out and into the interior of the upper end and the lower end of vertical frame members attached to both ends of the screen in a bent state and being led along the upper end and the lower end of the screen in the extended state, in which a plurality of unitized screen units are joined to each other so that the required number of the screen units can be arranged in parallel, whereby the limit of the widthwise dimension of the screen device in the direction of opening and closing the screen is eliminated.

It is another technical subject of the present invention to provide the folding screen device whose limit of the widthwise dimension of the screen device in the direction of opening and closing the screen is eliminated and, simultaneously, whose widthwise dimension is increased, wherein the screen can be opened and closed at a desired position of the screen units arranged in parallel.

It is still another technical subject of the present invention to provide a screen device in which maintenance of the screen unit, or replacement of the screen or a wire inserted thereto can be performed easily.

Means for Solving the Problems

In order to solve the above described problems, a folding screen device in the present invention includes screen units each having a screen being expandable in an according manner by being folded alternately in the opposite direction at a number of bending portions provided in parallel at regular intervals and being openable and closable by pulling in the lateral direction, and movable vertical frame members attached at both ends of the screen so as to be capable of sliding along a lateral frame member at an opening of a building, the screen unit including screen guides moving out and into the interiors of the vertical frame members through the upper ends and the lower ends thereof in a bent state and being led along the upper end and the lower end of the screen in an extended state for guiding the upper end and the lower end of the screen, and a horizontal movement mechanism for causing the movable vertical frame members to move in parallel during the opening and closing operation of the screen, wherein the adjacent vertical frame members of the plurality of screen units are disconnectably connected to each other so that the screen units can be arranged in parallel in the opening of the building.

According to a first preferred embodiment of the folding screen device in the present invention, the pair of the screen guides in the screen unit are fixed at one ends thereof to the upper end and the lower end of one of the vertical frame members and are arranged so as to move out and into the interior of the other vertical frame member through the upper end and the lower end in a bent state, while according to a second preferred embodiment, the pair of screen guides in the screen unit are fixed to the upper end of one of the vertical frame members and the lower end of the other vertical frame member respectively and arranged so as to move out and into the interior of the opposed vertical frame members through the upper end and the lower end in a bent state.

According to the first preferred embodiment of the folding screen device in the present invention, a parallel movement mechanism for causing the vertical frame members to move in parallel during opening and closing operation of the screen is configured by looped wire rotatably extended between the upper and lower portions in the interior of the vertical frame member which the screen guide moves out or into, and the portions thereof which move in the opposite directions are connected to ends of the respective screen guides.

According to the first preferred embodiment of the folding screen device in the present invention, the wire attached at one end thereof to the screen unit on the side of one of the vertical frame members, having inserted through the screen in the horizontal direction, is guided to the upper end of the other vertical frame member via redirecting means provided on the other frame member, is suspended from the upper end into the other vertical frame member, and is attached with a weight at the distal end thereof in the other vertical frame member, so that the screen can be automatically folded and stored.

In this case, at least three of the screen units can be supported by the lateral frame member at the opening of the building and inhibiting means for inhibiting the screen from being automatically folded by the weight in a state in which the screen is extended, whereby, even when the widthwise dimension of the screen device is increased, the screen can be opened and closed at a desired position of the screen units arranged in parallel.

According to the first preferred embodiment of the folding screen device, mounting plates fixed to both ends of the screen are disengageably engaged to the vertical frame members with the mounting members respectively, the wire to be inserted through the screen and attached with the weight being suspended at the distal end thereof is fixed at one end thereof to the mounting plate engaged with one of the vertical frame member and is detachably attached with the weight at the distal end of the wire suspending from the upper end of the other vertical frame member, and the other vertical frame member is provided with an operation opening for attaching and detaching the weight to the distal end of the wire and an insertion path for inserting the wire is configured to facilitate insertion and removal of the wire.

On the other hand, according to the second preferred embodiment of the folding screen device in the present invention, the parallel movement mechanism for causing the vertical frame members to move in parallel during the opening and closing operation of the screen is configured in such a manner that the one end of the wire to be inserted through the upper half of the screen in the horizontal direction is fixed to the vertical frame member which the screen guide moves out therefrom and therein through the upper end thereof, and the other end of the wire is led toward the lower portion in the other vertical frame member and is redirected upward in the lower portion, and is fixed at the distal end thereof to the distal end of the screen guide which moves out and into the vertical frame member through the lower end thereof, while one end of the wire to be inserted through the lower half of the screen in the horizontal direction is fixed to the vertical frame member which the screen guide moves out therefrom and therein through the lower end thereof and the other end of the wire is led toward the upper portion in the other vertical frame member, is redirected downward at the upper portion, and is fixed to the distal end of the screen guide which moves out and into the other vertical frame member through the upper end thereof.

According to the folding screen device, the mounting plates fixed to both ends of the screen is disengageably engaged with the vertical frame member respectively with the mounting members, while the wires inserted through the upper half and the lower half of the screen are fixed to the mounting plates engaged at one ends thereof to the mounting plates engaged with the vertical frame members respectively, having inserted at the other ends thereof through the mounting plate of the other vertical frame member, are led to the lower portion and the upper portion along the mounting plate, are redirected to the opposite direction at the lower portion and the upper portion, are detachably fixed at the distal ends thereof to the distal ends of the screen guides which moves out and into the vertical frame member through the upper end and the lower end, so that the screen through which the wires are inserted can be separated from the both vertical frame members together with the mounting plates on the both ends thereof by separating the distal end of the respective wires from the distal ends of the screen guides.

Furthermore, according to the preferred embodiment of the folding screen device in the present invention, the upper ends of the pairs of vertical frame members of the respective screen units are fitted and held in a supporting groove of the lateral frame member on the upper portion of the opening of the building, and rails for preventing the upper ends of the screen units from coming apart by engaging with projections provided on the upper ends of the respective vertical frame members are provided at the opening edges of the supporting groove, the rails are formed with slits for allowing passage of the projections, and the slits are closed by caps detachable with respect to the lateral frame member. The projections may be formed of rollers which roll on the rails.

ADVANTAGES OF THE INVENTION

According to the folding screen device of the present invention described in detail above, in the folding screen device including a screen guide for guiding the upper end and the lower end of the screen by moving out and into the interior of the upper end and the lower end of vertical frame members attached to both ends of the screen in a bent state and being led along the upper end and the lower end of the screen in the extended state, a plurality of unitized screen units are joined to each other so that the required number of the screen units can be arranged in parallel, whereby the limit of the widthwise dimension of the screen device in the direction of opening and closing the screen is eliminated.

In the folding screen device whose limit of the widthwise dimension is eliminated and, simultaneously, whose widthwise dimension is increased, the screen can be opened and closed at a desired position of the screen units arranged in parallel, as well as maintenance of the screen unit, or replacement of the screen or a wire inserted thereto can be performed easily.

BEST MODE FOR CARRYING OUT THE INVENTION

FIG. 1 to FIG. 16 shows a first embodiment of a folding screen device according to the present invention. As shown in FIG. 4 and FIG. 5, a screen device 1 generally includes a lateral frame member 3 to be mounted to the upper portion of an opening 2 of a building and a plurality of screen units 10 which is capable of sliding along the lateral frame member 3. The screen units 10 each includes a screen 12 which can be opened and closed by pulling laterally, and can be arranged in parallel by an adequate number so as to match the widthwise dimension of the opening 2 of the building in the direction of opening and closing the screen 12, whereby the widthwise dimension of the screen device 1 can be extended arbitrarily so as to match the width of the opening 2 of the building.

As shown in FIG. 1 and FIG. 2, the screen unit 10 includes the screen 12 which is adapted to be expandable in an accordion manner by folding alternately in the opposite direction at a number of bending portions arranged in parallel at regular intervals. This embodiment illustrates a case in which the screen 12 is configured as an insect screening net which can be opened and closed by pulling laterally.

A movable vertical frame member 13 that accommodates the screen guides 20A, 20B, described later, moving into and moving out the upper end and the lower end thereof is attached to an end of the screen 12, and a movable vertical frame member 14 is attached to the other end of the screen 12, so that the screen 12 can be opened and closed along the lateral frame member 3 of the opening 2 of the building in the screen unit 10 and, simultaneously, the screen unit 10 is adapted to be capable of sliding along the lateral frame member 3. In this case the vertical frame members 13, 14 of the plurality of screen units 10 adjacent to each other are detachably connected to each other by connecting means including a magnet 17 and an adsorbing plate 18 which is adsorbed thereto, whereby a plurality of screen units 10 can be operated to open and close entirely by the opening and closing operation of some of screen units 10. The connecting means is not limited to the magnet and the adsorbing plate.

In this configuration, even though the widthwise dimension in the direction of opening and closing of the screen 12 is increased, the screen 12 can be extended over the entire width of the opening 2 of the building (see FIG. 4). Since the screen unit 10 is capable of sliding along the lateral frame member 3 in itself, the both vertical frame members 13, 14 can be used for the opening and closing operation of the screen 12, so that the screen can be opened entirely or partly by the desired screen unit 10 installed at the opening 2 of the building (see FIG. 5).

In addition, since the screen unit 10 is configured to be able to store the screen 12 between the both vertical frame members 13, 14 when the screen 12 is folded between the vertical frame members 13, 14, the lateral width of the screen unit 10 is very small when the screen is folded and hence the opening of the building can be widely opened.

The screen guides 20A, 20B which move out and into the interior of the one vertical frame member 13 of the screen unit 10 through the upper end and the lower end in a bent state and are led out or in along the upper end and the lower end of the screen 12 in the extended state are configured by connecting a number of guiding pieces 21 with a flexible wire 22 as shown in FIG. 1, FIG. 2 and FIG. 6.

The guiding pieces 21 each are formed substantially into a U-shape by a bottom portion 21*a* which extends along the upper end and the lower end of the screen 12 and upright wall portions 21*b* extending upright along the outer surface of the screen 12, includes through holes 21*c* for inserting the wires 22 along the upper end portions of the upright wall portions 21*b* of each guiding piece 21, and are connected by inserting the lengths of wires 22 through the respective through holes 21*c* of each guide piece 21 so as to be capable of bending only in the direction in which the wires are inserted. The ends of the wires 22 are fixed to the outer ends of the guide pieces 21 at both ends of the screen guides 20A, 20B so as to be prevented from coming apart.

The screen guides 20A, 20B, moving out and into the interior of the vertical frame member 13 through the upper end and the lower end in a bent state at the end on one side and being fixed to the upper end and the lower end of the other vertical frame member at the end on the other side, are led out and in the interior of the vertical frame member 13 through the upper and lower ends according to the opening and closing operation of the screen 12 in association with the movement of the vertical frame member 13 or the vertical frame member 14, thereby guiding the upper end and the lower end of the screen 12 and, simultaneously, constituting the upper and lower frame members of the screen unit 10 in itself.

As shown in FIG. 1, the vertical frame member 13 which the screen guides 20A, 20B move out and into is provided with a parallel movement mechanism which causes the vertical frame members 13, 14 to move stably in parallel during the opening and closing operation of the screen 12 in cooperation of a loop wire 24 rotatably extended between the upper and lower portions in the interior of the vertical frame member 13 and the screen guides 20A, 20B.

In other words, the wire 24 is rotatably extended in a loop shape between redirecting members (rollers) 23*a*, 23*b* provided in the upper and lower portions of the interior of the vertical frame member 13, and portions thereof which move in the opposite directions are connected to the guide pieces 21 at the distal ends of the respective screen guides 20A, 20B led into the vertical frame member 13 at the connecting portions 24*a*. Therefore, the screen guides 20A, 20B guide the upper and lower ends of the screen 12 and, simultaneously, cause the screen guides 20A, 20B to move out and into the vertical frame member 13 by a corresponding length, whereby the vertical frame members 13, 14 can be moved stably in parallel.

A guide rail 4 is provided on a floor surface of the opening 2 of the building for guiding the movement of the screen guide 20B led along the lower end of the screen 12 along a predetermined course in order to achieve a stable sliding movement of the screen guide 20B which guides the lower end of the screen 12 along the predetermined course, that is, in order to achieve a stable opening and closing of the screen 12. The guide piece 21 is provided with guide ridges 21*d* on both sides on the back surface of the bottom portion 21*a* thereof, so that the screen guide 20B is able to slide along the guide rail 4 stably by fitting the guide ridges 21*d* on the outsides of the guide rail 4. As shown in FIG. 1 and FIG. 3, the height of the guide rail 4 is as low as it does not hinder passage of pedestrian or wheelchairs.

On the other hand, the lateral frame member 3 which guides the movement of the screen unit 10 at the upper portion of the opening 2 of the building is provided with pending walls 3*a* on the front and rear side thereof, is formed with a supporting groove 3*d* for slidably fitting and holding the upper ends of the pair of vertical frame members 13, 14 of the respective screen units 10 between the pair of pending walls 3*a*, and is provided with a pair of rails 3*b* along the opening edges of the supporting groove 3*d*, and the respective vertical frame members 13, 14 is provided with projections 15, 16 that engage the rails 3*b* when the screen unit 10 slants on the front and rear surface at the upper ends thereof for restraining the upper end of the screen unit 10 from coming apart from the supporting grooves 3*d* due to the slanting of the screen unit 10 in itself.

The projections 15, 16 are formed of rollers that roll on the rails 3*b*. In the folding screen device according to the first embodiment in the drawing, the positions of the projections 15, 16 are illustrated on the upper end side of the vertical frame members 13, 14 in order to explain a mode of insertion and removal of the upper end of the screen unit 10 to/from the supporting groove 3*d* of the lateral frame member 3 as will be described in conjunction with FIG. 14 and FIG. 16 later. However, the projections (rollers) 15, 16 roll actually on the rails 3*b* as shown in FIG. 7. The projections 15, 16 do not necessarily have to be rollers.

As will be understood from FIG. 8(*a*), FIG. 8(*b*), FIG. 9(*a*) and FIG. 9(*b*), mounting plates 25*a*, 25*b* formed of synthetic resin, aluminum, or the like are attached to both ends of the screen 12 in the direction of expansion, while screen 12 mounting surfaces of the vertical frame members 13, 14 are formed with engaging grooves 13*b*, 14*b* by pairs of engaging strips 13*a*, 13*a* and 14*a*, 14*b* extending in the longitudinal direction in a state of facing to each other so as to extend along the screen 12 mounting surface, and the both ends of the screen 12 are detachably attached to the vertical frame members 13, 14 by fitting a plurality of mounting members 28 in the engaging grooves 13*b*, 14*b* in a state in which the mounting plates 25*a*, 25*b* attached to the screen 12 are engaged with the engaging grooves 13*b*, 14*b* on the respective vertical frame members.

The mounting members 28 each includes a leaf spring portion 28*a* which can expand and contract in the direction of the width of the vertical frame members 13, 14 by being formed of a flexible synthetic resin into a loop on one side thereof, and a plate portion 28*b* and ridges 28*c* formed on one surface of the plate portion 28*b* used for engaging and disengaging operation on the other side. The ridges 28*c* are used to compress the leaf spring portion 28*a* by hooking a projecting object or the like when engaging and disengaging the mounting member 28 with respect to the engaging grooves 13*b*, 14*b* on the vertical frame members 13, 14.

Therefore, when fitting the mounting members 28 to the engaging grooves 13*b*, 14*b* in the vertical frame members 13, 14, the leaf spring portion 28*a* is compressed in a state in which the plate portion 28*b* is inserted inside one of the engaging strips 13*a*, 14*a* of the engaging grooves 13*b*, 14*b*, and in this state, the plate portion 28*b* is fitted inside the other one of the engaging strips 13*a*, 14*a* of the engaging grooves 13*b*, 14*b*. In contrast, when detaching the mounting member 28 out from the engaging grooves 13*b*, 14*b*, the projecting object such as nail is hooked between the ridges 28*c* formed on the plate portion 28*b* of the mounting member 28 and compressing the leaf spring portion 28*a*, so that they can be detached out from the engaging grooves 13*b*, 14*b* (see FIG. 9(*a*) and FIG. 9(*b*)).

Wires 30*a* to 30*c* are inserted through the screen 12 in multi levels in the horizontal direction respectively at substantially regular intervals on the upper and lower portions and an intermediate portion therebetween, and one ends of the respective wires 30*a*-30*c* is fixed to the mounting plate 25*a* at the end of the screen 12 attached on the side of the vertical frame member 13. The other ends of the wires 30*a*-30*c*, after having inserted through the screen 12 in the horizontal direction, are passed through sliding members, not shown, and the wires 30*b*, 30*c* except for the upper wire 30*a* are redirected upward by redirecting means formed by the sliding members and led upward in a groove 29 (see FIG. 9(*b*)) provided on the screen 12 mounting surface of the vertical frame member 14, and then as shown in FIG. 8(*b*) and FIG. 10, these wires are led into the vertical frame member 14 through the upper leading port 14*c* of the vertical frame member 14 together with the upper wire 30*a*, and are extended downward via a redirection guide 14*d* at the lower edge of the leading port 14*c*, and a weight 32 is detachably attached to the distal ends of the wires 30*a*-30*c* via a hook 33 in the vertical frame member 14 so as to be suspended therefrom.

The wires 30*a*-30*c* inserted through the screen 12 may be suspended separately in the vertical frame member 14 with the weights 32 provided at the distal ends thereof, or alternatively, may be suspended altogether. In this manner, when the plurality of wires 30*a*-30*c* are inserted through the screen 12 in multi levels and a force of the weight 32 is applied to the wires 30*a*-30*c*, the wires can function as a parallel movement mechanism for causing the vertical frame members 13, 14 to move in parallel by the tensile force applied substantially uniformly to the respective wires 30*a*-30*c*, and can prevent the screen 12 from swelling leeward due to an action of a wind pressure or the like.

The mode of extension of the respective wires 30*a*-30*c* is not limited to the mode described above.

The weight of the weight 32 to be suspended at the distal ends of the wires 30*a*-30*c* may be the weight sufficient for supplementing the folding force of the screen 12, and may be the weight which can fold the screen by the gravitational force of the weight 32 to open the screen 12 from the extended state automatically when the connection between the vertical frame members 13, 14 of the adjacent screen unit 10 with a magnet or the like is released from the state in which the screen is extended.

However, when the lateral frame member 3 at the opening 2 of the building supports three or more of the screen units 10, the screen 12 can be opened partly by providing inhibiting means that inhibit automatic folding of the screen 12 by the weight 32 in the state in which the screen 12 is extended on all or some of the screen units 10 so that the screens 12 of the respective screen units 10 are completely folded by the gravitational force of the weight 32 and hence the opening 2 of the building is restrained from being fully opened when the connection by the magnet or the like between the vertical frame members 13, 14 of the adjacent screen units 10 is released.

As the inhibiting means for inhibiting the automatic folding of the screen 12 by the weight 32, for example, means for supporting the weight 32 by an operator such as a pin which acts on the weight 32 from the outside through the vertical frame member 14 to stop the action of the weight instantaneously, or means for enabling instantaneous detachment of the weight 32 or replacement of the weight 32 with a light one easily may be employed in all or some of the screen units 10.

As described above, in the screen unit 10, since the mounting plates 25*a*, 25*b* fixed to the both ends of the screen 12 are disengageably engaged with the vertical frame members 13, 14 respectively by the mounting members 28, the wires 30*a*-30*c* are fixed at the one ends thereof to the mounting plates 25*a*, and are inserted through the mounting plates 25*b* and suspended from the upper end of the vertical frame member 14 at the other ends thereof with the weight 32 detachably attached to the distal ends thereof, the screen 12 can be detached from the vertical frame members 13, 14 and the screen guides 20A, 20B together with the wires 30*a*-30*c* for maintenance of the screen unit 10 or replacement of the screen 12 as shown in FIG. 13.

As shown in FIG. 9(*b*) and FIG. 12, the vertical frame member 14 is provided with an operation opening 35 for attaching and detaching the weight 32 to the distal ends of the wires for achieving easy detachment of the wires 30*a*-30*c* from the vertical frame member 14, the opening 35 is closed with a detachable lid 36, and an insertion path 14*c* for inserting the wires 30*a*-30*c* are configured to facilitate insertion and removal of the wires.

More specifically, the insertion path 14*c* for inserting the wires 30*a*-30*c* are configured, as shown in FIG. 10 and FIG. 11, not only in such a manner that the wires can be inserted therethrough together with the hooks 33 at the distal ends thereof, but also in such a manner that a hole 14*e* which is larger than an entrance of the insertion path 14*c* of the vertical frame member 14 is provided on the opposite side surface opposing to the entrance so that the hook 33 can be inserted straight from the entrance of the insertion path 14*c* and led to the hole 14*e* (see FIG. 11), so that the hook 33 can be dropped again from the hole 14*e* into the vertical frame member 14 easily with the aid of an inclined surface at the lower portion of the hole, whereby the inserting operation of the hook 33 and the wire into a narrow space in the vertical frame member 14 is facilitated. Mounting of the weight 32 to the hook 33 can be performed easily through the opening 35 with the lid 36 opened.

As described above, the screen unit 10 is provided with projections 15, 16 that engage the rails 3*b* when the screen unit 10 slants at the upper ends of the vertical frame members 13, 14 for preventing the upper end of the screen unit 10 from coming apart from the supporting grooves 3*d* on the lateral frame member 3 due to the slanting of the screen unit 10 in itself, the rails 3*b* are formed with slits 3*c* for allowing passage of the projections 15, 16 at the centers thereof for mounting the screen unit 10 to the lateral frame member 3 or allowing detachment from the lateral frame member 3 for maintenance or the like, and the slits are closed by caps 38 detachably attached to the lateral frame member 3 (see FIG. 1, FIG. 14 and FIG. 16).

FIG. 15(*a*) and FIG. 15(*b*) show a mode of attaching and detaching the caps 38 to the slits 3*c*. The lateral frame member 3 is provided with small holes 3*e* at portion of the lower edges of the pending walls 3*a* corresponding to the slits 3*c* formed by cutting off the rails 3*b* for fixing the caps 38 with screws 39, while the caps 38, being formed of synthetic resin, metal or the like, each have a surface 38*a* that closes the slits 3*c* at a level flush with the surface of the rail 3*b*, and have a cut groove 38*b* for being fitted to the lower edge of the pending wall 3*a* of the lateral frame member 3 and a screw hole 38*c* for being fixed with the screw 39 through the small hole 3*e* provided on the pending wall 3*a* of the lateral frame member 3.

Therefore, the caps 38 can be fixed to the slits 3*c* by screwing the screws 39 into the screw holes 38*c* in the state shown in FIG. 15(*a*), and the caps 38 can be detached as shown in FIG. 15(*b*) by pulling out the caps 38 from the pending walls 3*a* of the lateral frame member 3 in the state shown in the same drawing, so that the screen unit 10 can be attached to the lateral frame member 3 or detached from the lateral frame member 3.

As shown in FIG. 14, when detaching the screen unit 10 from the lateral frame member 3, the caps 38 fixed to the lower edges of the pending walls 3*a* are removed as shown in FIG. 14 to open the slits 3*c* of the rails 3*b* of the lateral frame member 3 (see FIG. 14), and then, the screen unit 10 is slanted and the projections 16, 15 provided at the upper ends of the vertical frame members 14, 13 are extricated in sequence from the slits 3*c*, so that the screen unit 10 can be removed from the lateral frame member 3, as shown in FIG. 16. In contrast, when mounting the screen unit 10 to the lateral frame member 3, the screen unit 10 can be attached to the lateral frame member 3 in reverse order.

FIG. 17 and FIG. 18 illustrate a second embodiment of the invention, and a folding screen device 5 in the second embodiment is configured in such a manner that a pair of screen guides 50A, 50B of screen units 40, which correspond to the screen unit 10 in the first embodiment, are fixed at one ends to an upper end of one vertical frame members 44 and an lower end of the other vertical frame member 43, and are arranged so that the other ends move out and into the upper ends and the lower ends of the vertical frame members 43, 44 oppose to each other, thereby being led along the upper end and the lower end of the screen 42 which is expandable in an accordion manner as the one described above in an extended state to guide the upper end and the lower end of the screen 42. The configurations of the screen guides 50A, 50B in themselves are the same as those in the first embodiment described in conjunction with FIG. 6. Since the principal point of the second embodiment which differs from the first embodiment is the configuration of installation of the screen guides 50A, 50B and the configuration of portions related thereto, and other configurations are substantially the same, the configuration of the principal point will be mainly described in the following description.

Mounting plates 55*a*, 55*b* fixed to both ends of the screen 42 are engaged with engaging grooves (corresponding to the engaging grooves 13*b*, 14*b* in the first embodiment) formed by the engaging strips which correspond to the pairs of engaging strips 13*a*, 13*a* and 14*a*, 14*a* in the first embodiment (see FIG. 8(*a*), FIG. 8(*b*), FIG. 9(*a*) and FIG. 9(*b*)) and, in this state, are disengageably engaged with the vertical frame members 43, 44 by fitting a plurality of mounting members 28 into the engaging grooves.

When operating the screen 42 to open and close, a plurality of wires 54*a*-54*c* inserted through the screen 42 in the horizontal direction and the pair of upper and lower screen guides 50A, 50B described above are used as the parallel movement mechanism for moving the movable vertical frame members 43, 44 in parallel. Unlike the wires 30*a*-30*c* in the first embodiments, the wires 54*a*-54*c* do not function to open the opening of the building by folding the screen in the extended state, but constitute the parallel movement mechanism for the vertical frame members 43, 44 as described below.

In other words, the wire 54*a* inserted horizontally in the upper half side of the screen 42 is fixed at one end thereof to the mounting plate 55*a* engaged with the vertical frame member 43 which the screen guide 50A moves out and into through the upper end thereof, inserted at the other end thereof through the screen 42 and the mounting plate 55*b* of the other vertical frame member 44, led to the lower portion thereof along the mounting plate 55*b*, is redirected upward by the redirecting member 53*a* provided at the lower portion, and is fixed at the distal end thereof to the distal end of the screen guide 50B moving out and into the vertical frame member 44 through the lower end thereof. On the other hand, the wires 54*b*, 54*c* inserted horizontally through the lower half side of the screen 42 are fixed at one ends thereof to the mounting plate 55*b* engaged with the vertical frame member 44 which the screen guide 50B moves out and into through the lower end thereof and inserted at the other ends thereof through the mounting plate 55*a* of the vertical frame member, led to the upper portion thereof along the mounting plate 55*a*, are directed downward by the redirecting member 53*b* provided at the upper portion, and are fixed at the distal ends thereof to the distal end of the screen guide 50A moving out and into the vertical frame member 43 from the upper end thereof.

In this configuration, the respective screen guides 50A, 50B are led out and in along the upper side and the lower side of the screen 42 in association with the opening and closing operation of the screen 42 by the vertical frame members 43, 44 and guide the upper and lower ends of the screen 42 and, simultaneously, the lengths of the wires 54*a*-54*c* between the mounting plates 55*a*, 55*b* are changed by a length corresponding to the amount of movement of the distal ends of the both screen guides 50A, 50B, so that the vertical frame members 43, 44 can be moved stably in parallel as a result.

The folding screen device 5 is configured in such a manner that the screen 42 through which the wires 54*a*-54*c* are inserted through can be separated from the both vertical frame members 43, 44 together with the mounting plates 55*a*, 55*b* at both ends for maintenance of the screen unit 40 or replacement of the wires 54*a*-54*c*.

In other words, as shown in FIG. 18, since the mounting plates 55*a*, 55*b* fixed to both ends of the screen 42 are disengageably engaged with the respective vertical frame members 43, 44 by the mounting members 28, as described above, they can be separated from the both vertical frame members 43, 44. In addition, since the wires 54*a*-54*c* inserted through the upper half and the lower half of the screen 42 are fixed at one ends thereof to the mounting plates 55*a*, 55*b* engaged with the vertical frame members 43, 44 respectively, the wires can be separated from the both vertical frame members 43, 44 together with the mounting plates 55*a*, 55*b*. Since the other ends of the wires 54*b*, 54*c*, having inserted through the mounting plates 55*a*, 55*b* of the other vertical frame members 43, 44, are guided toward the lower portion and the upper portion in the recessed groove (the same recessed groove as the recessed groove 29*a* in the first embodiment) provided on the screen 12 mounting surfaces of the vertical frame members 43, 44 along the mounting plates, are redirected to the opposite direction by the redirecting members 53*a*, 53*b* provided on the vertical frame members 43, 44 at the lower portion and the upper portion, and are detachably fixed to the distal ends of the screen guides 50A, 50B which move into and out the upper end and the lower end of the vertical frame members 43, 44 at the distal ends thereof, the screen 42 through which the wires 54*a*-54*c* are inserted can be detached from the both vertical frame members 43, 44 together with the mounting plates 55*a*, 55*b* at both ends thereof by separating the distal ends of the respective wires 54*a*-54*c* from the distal ends of the screen guides 50A, 50B. The vertical frame members 43, 44 may be provided with the operation opening for attaching and detaching the distal ends of the respective wires 54*a*-54*c* to the distal ends of the screen guides 50A, 50B as needed.

As is clear from the description given above, the screen device 5 is configured in such a manner that the screen 42 can be opened and closed along the lateral frame member 3 provided at the opening 2 of the building in the screen unit 40 and, simultaneously, the plurality of screen units can be slid along the lateral frame member 3. The adjacent vertical frame members 43, 44 in the plurality of screen units 40 are disconnectably connected to each other by connecting means including a magnet 47 and an adsorbing plate 48 for adsorbing the same, whereby the plurality of screen units 40 can be operated to open and close entirely by the opening and closing operation of a part of the screen units 40.

In order to cause the screen guide 50B for guiding the lower end of the screen 42 to be capable of sliding stably along the predetermined course as in the case of the screen device in the first embodiment, the guide rail 4 for guiding the movement of the screen guide 50B led out along the lower end of the screen 42 is provided on the floor surface at the opening 2 of the building. Then, as shown in FIG. 6, by fitting the guide ridges 21*d* provided on the both side ends of the back surfaces of the bottom portions 21*a* thereof of the screen guide 50B to the outside of the guide rail 4, the screen guide 50B can slide stably along the guide rail 4.

On the other hand, the lateral frame member 3 that guides the movement of the screen unit 40 on the upper portion of the opening 2 of the building, having substantially the same configuration as in the case of the first embodiment, is formed with a supporting groove (3*d* in FIG. 3) for slidably fitting and holding the upper ends of the pair of vertical frame members 43, 44 of the respective screen units 40, is provided with the pair of rails 3*b* at the opening edges of the supporting groove, and is provided with projections 45, 46 for restraining the upper ends of the screen units 40 from coming apart from the supporting groove 3*d* due to the slanting thereof.

Although the projections 45, 46 are formed of rollers that roll on the rails 3*b* as in the case of the first embodiment, they do not necessarily have to be rollers.

Although slits for allowing passage of the projections 45, 46 are provided at the centers of the rails 3*b* so that the screen units 40 can be mounted to the supporting groove 3*d* of the lateral frame member 3 or demounted from the lateral frame member 3, and the slits are closed by the caps 38 detachable to the lateral frame member 3, since the configuration is not different from the one described in the first embodiment, the description thereof is omitted here.

BRIEF DESCRIPTION OF THE DRAWINGS

FIG. 8(*b*) is a partial perspective view for explaining the mode for detaching the screen to the vertical frame member 13.

FIG. 9(*b*) is a partial cross-sectional view for explaining a mode for attaching and detaching the mounting member in FIG. 8(*b*).

FIG. 15(*b*) is a partial enlarged side cross-sectional view for explaining the mode of detaching the caps to the lateral frame member.

Reference Numerals

Figure 1:
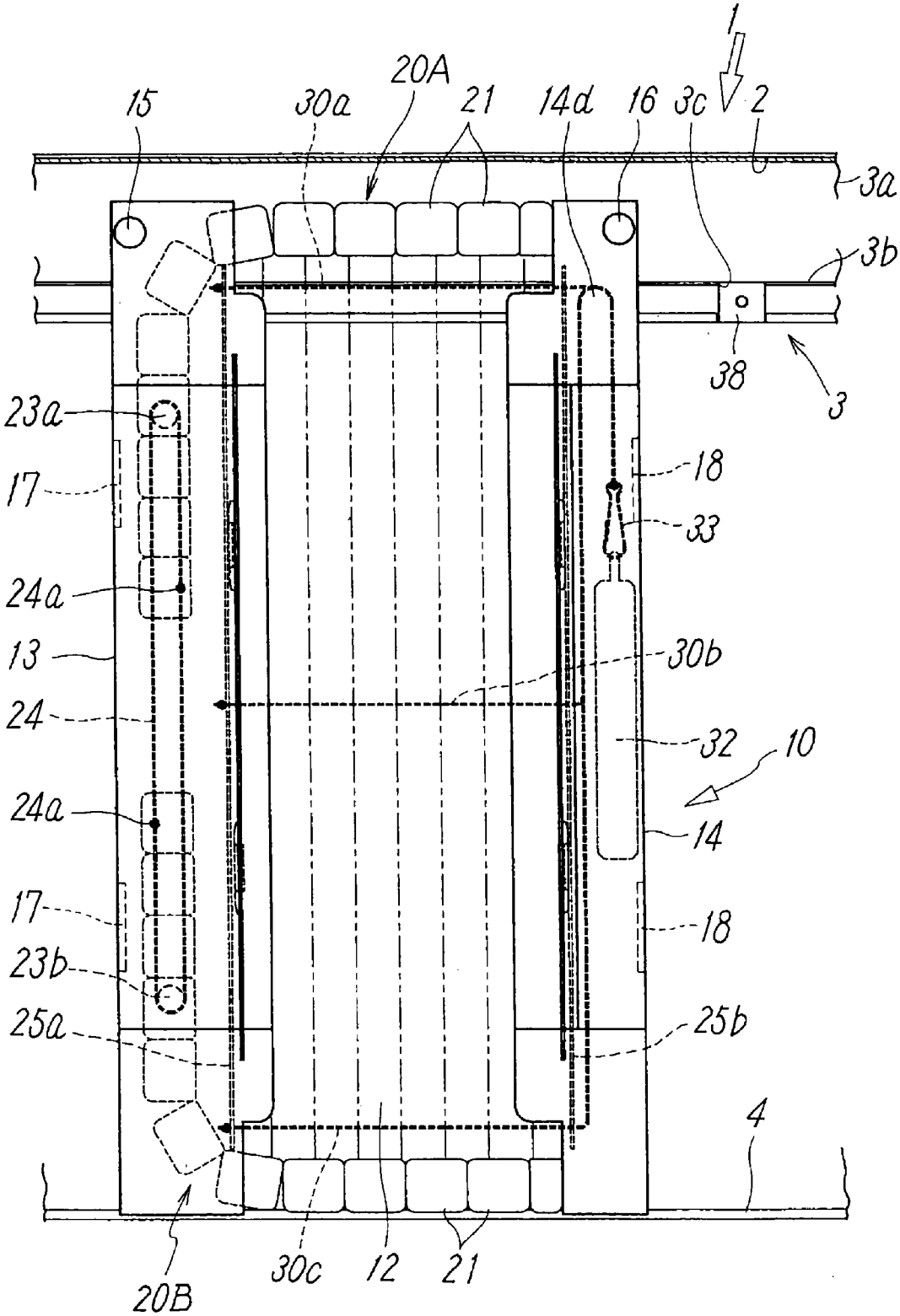
FIG. 1 is a front view partly broken showing a first embodiment of a folding screen device according to the present invention.
Figure 2:
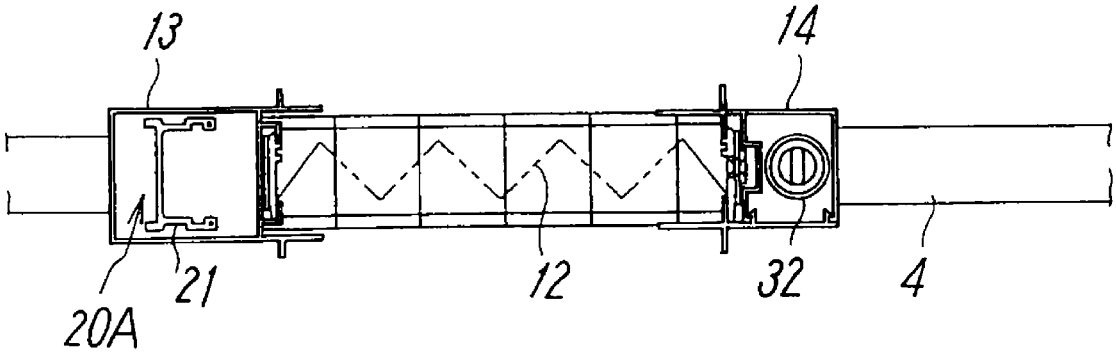
FIG. 2 is a top cross-sectional view of the same.
Figure 3:
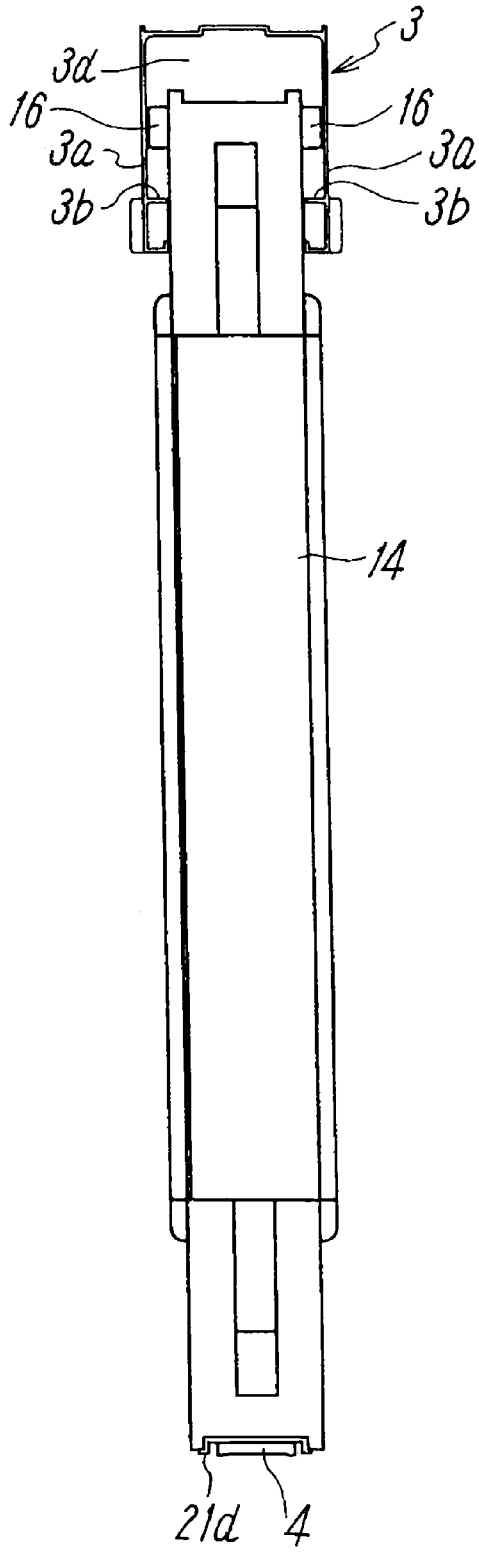
FIG. 3 is a side end view of the same.
Figure 4:
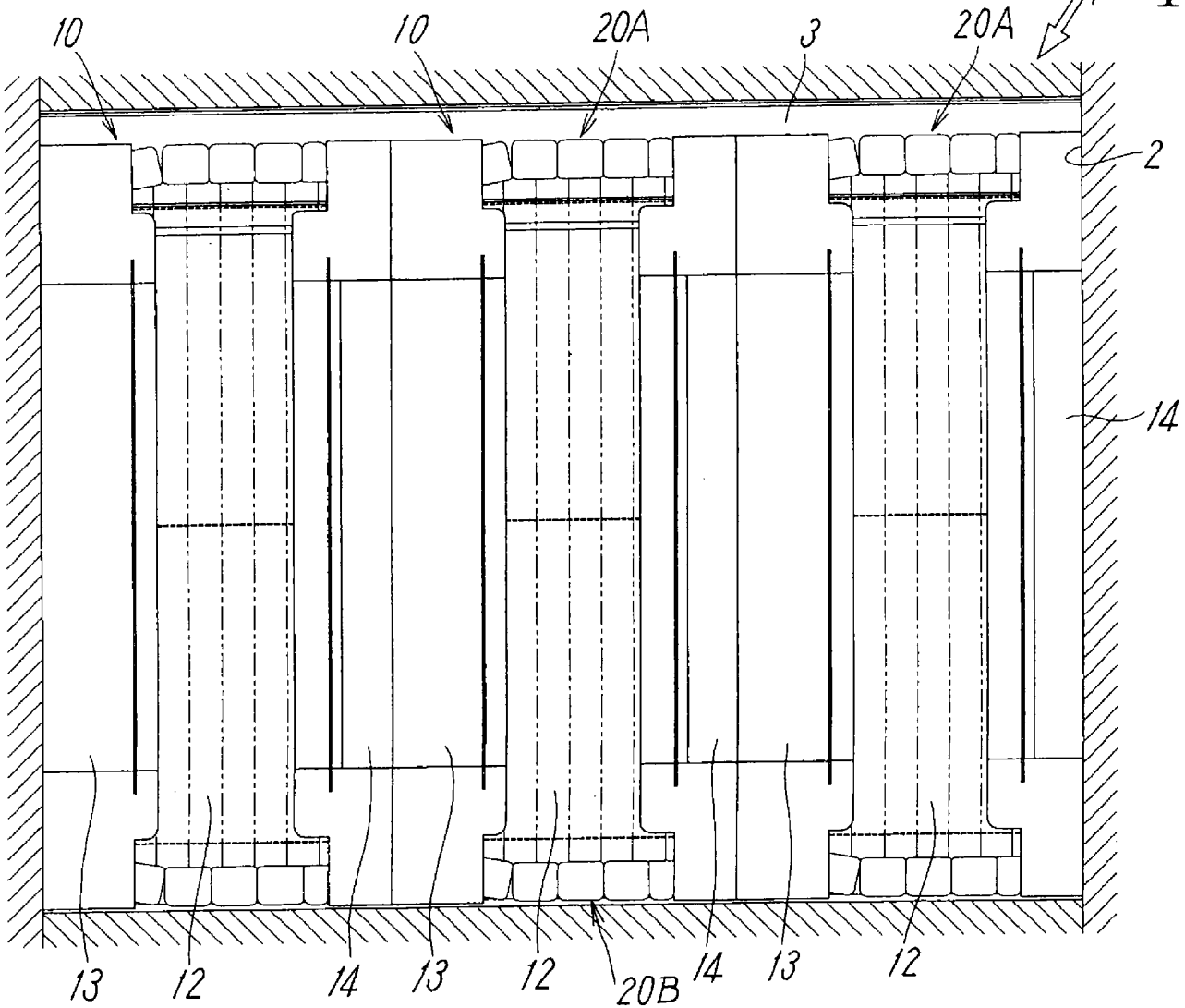
FIG. 4 is a front view showing a state in which the folding screen device is installed and a screen is extended in an opening of a building.
Figure 5:
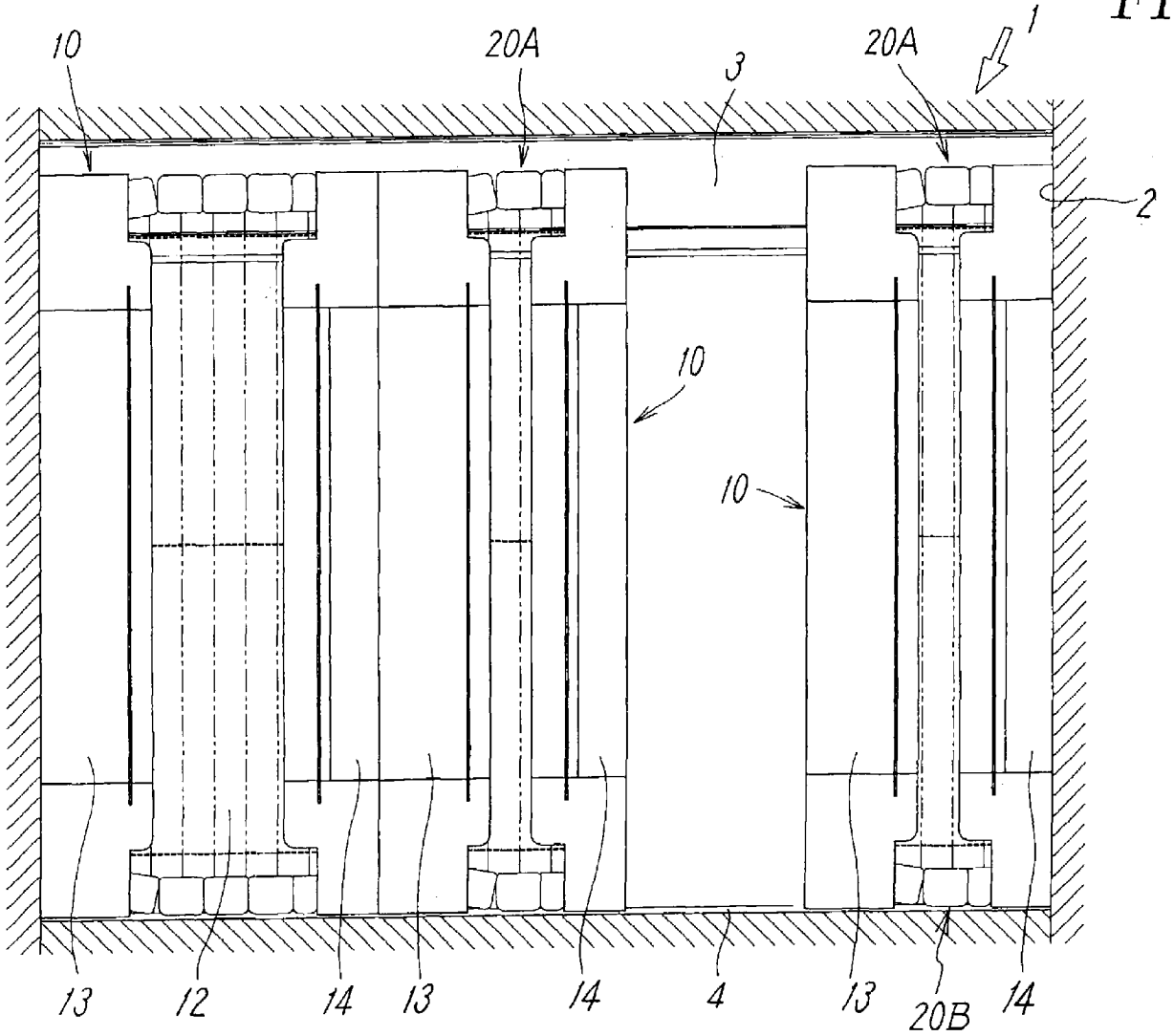
FIG. 5 is a front view showing a state in which part of screen units are opened in the folding screen device in FIG. 4.
Figure 6:
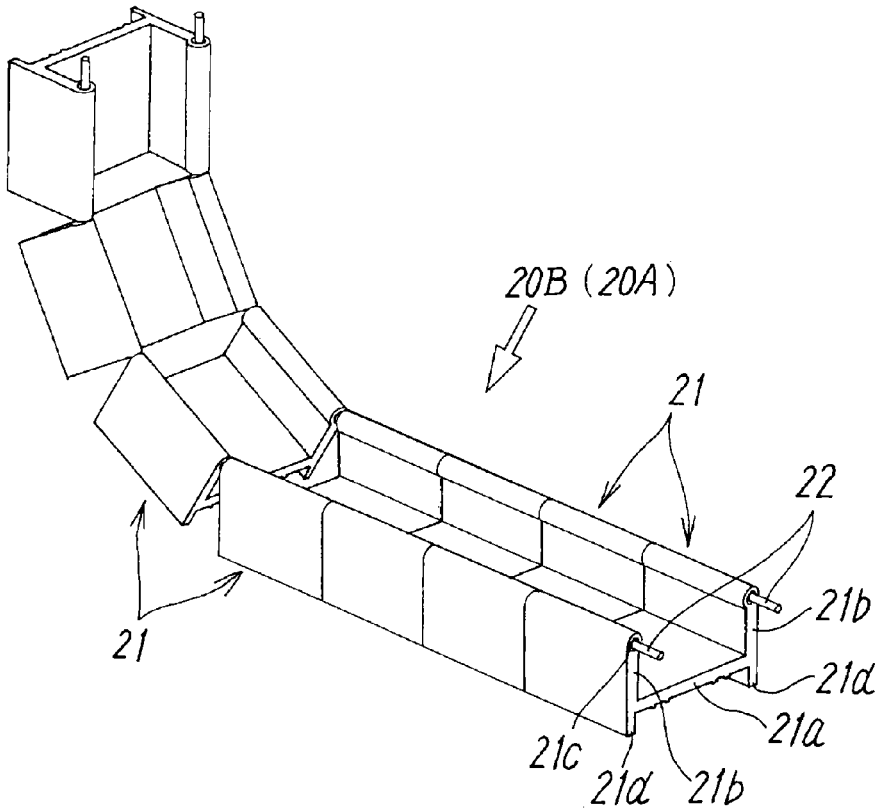
FIG. 6 is an enlarged perspective view showing a principal portion showing a configuration of a screen guide.
Figure 7:
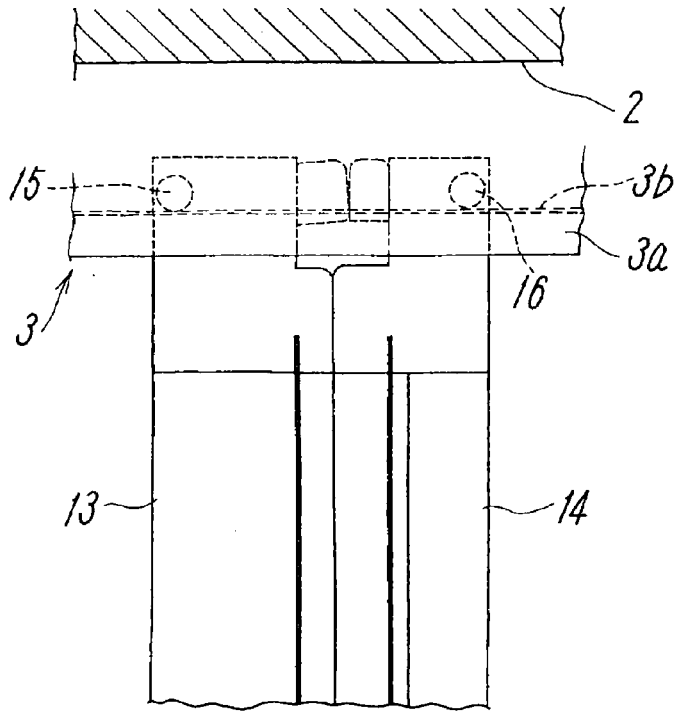
FIG. 7 is a partial front view showing a relative configuration between a lateral frame member and projections (rollers).
Figure 8A:
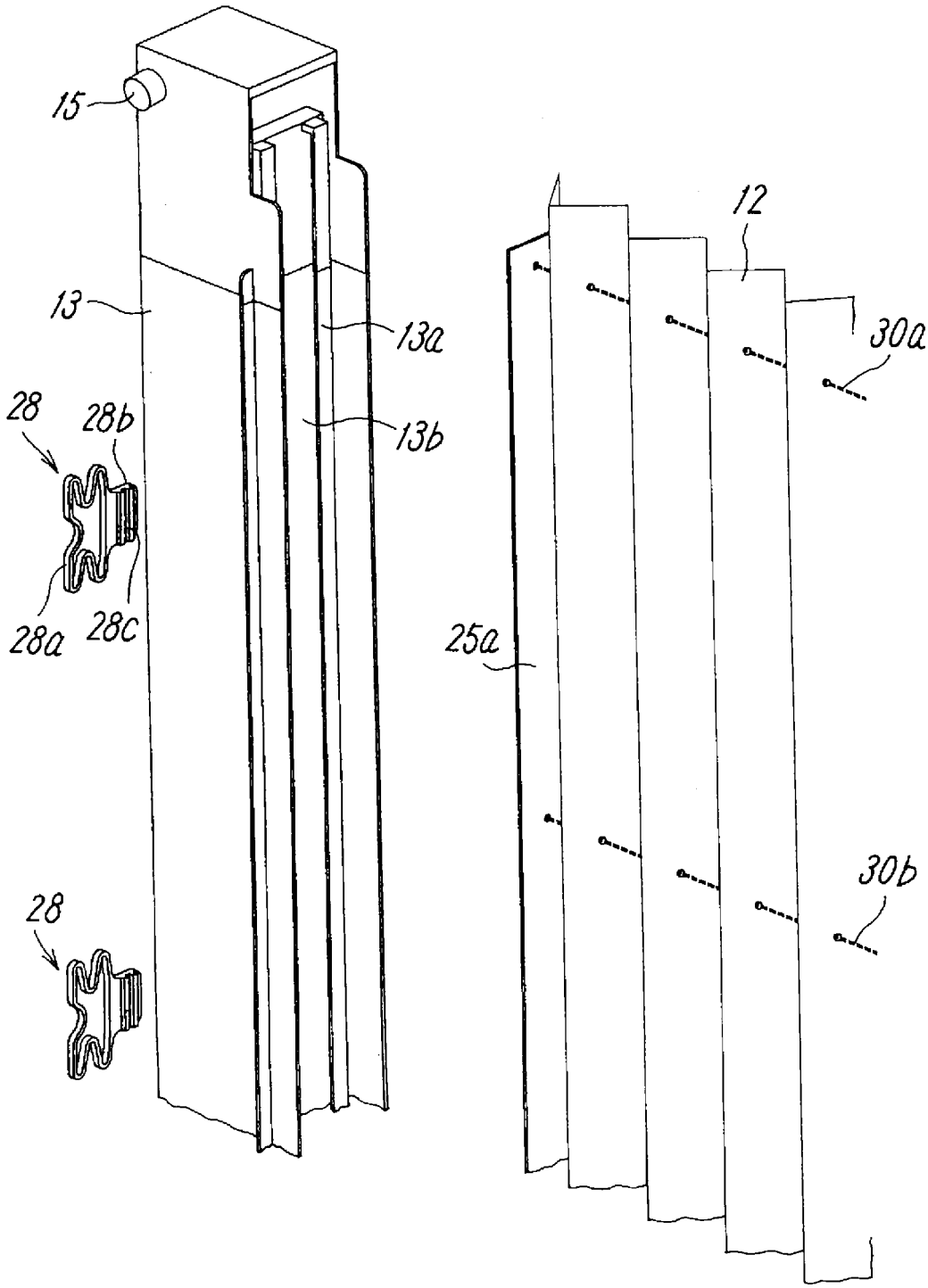
FIG. 8(*a*) is a partial perspective view for explaining a mode of detaching the screen to a vertical frame member 13.
Figure 8B:
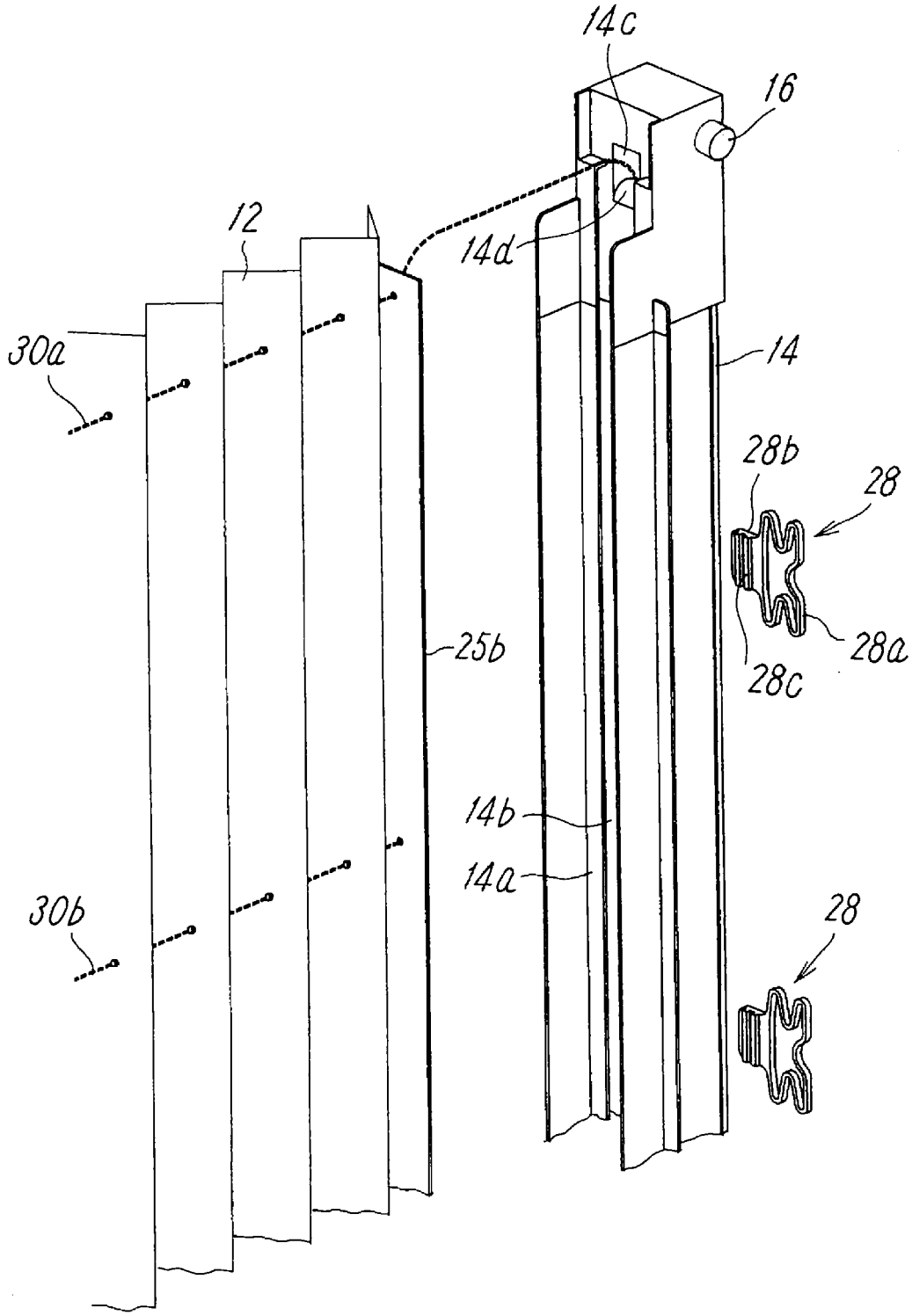
Figure 9A:
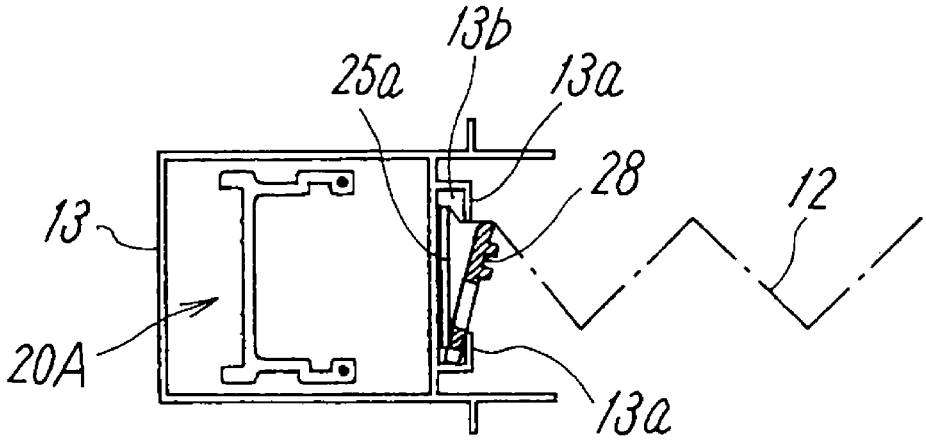
FIG. 9(*a*) is a partial cross-sectional view for explaining a mode for attaching and detaching the mounting member in FIG. 8(*a*).
Figure 9B:
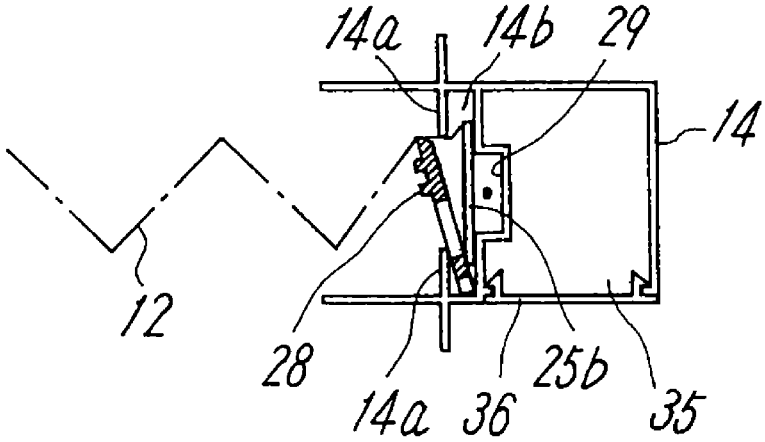
Figure 10:
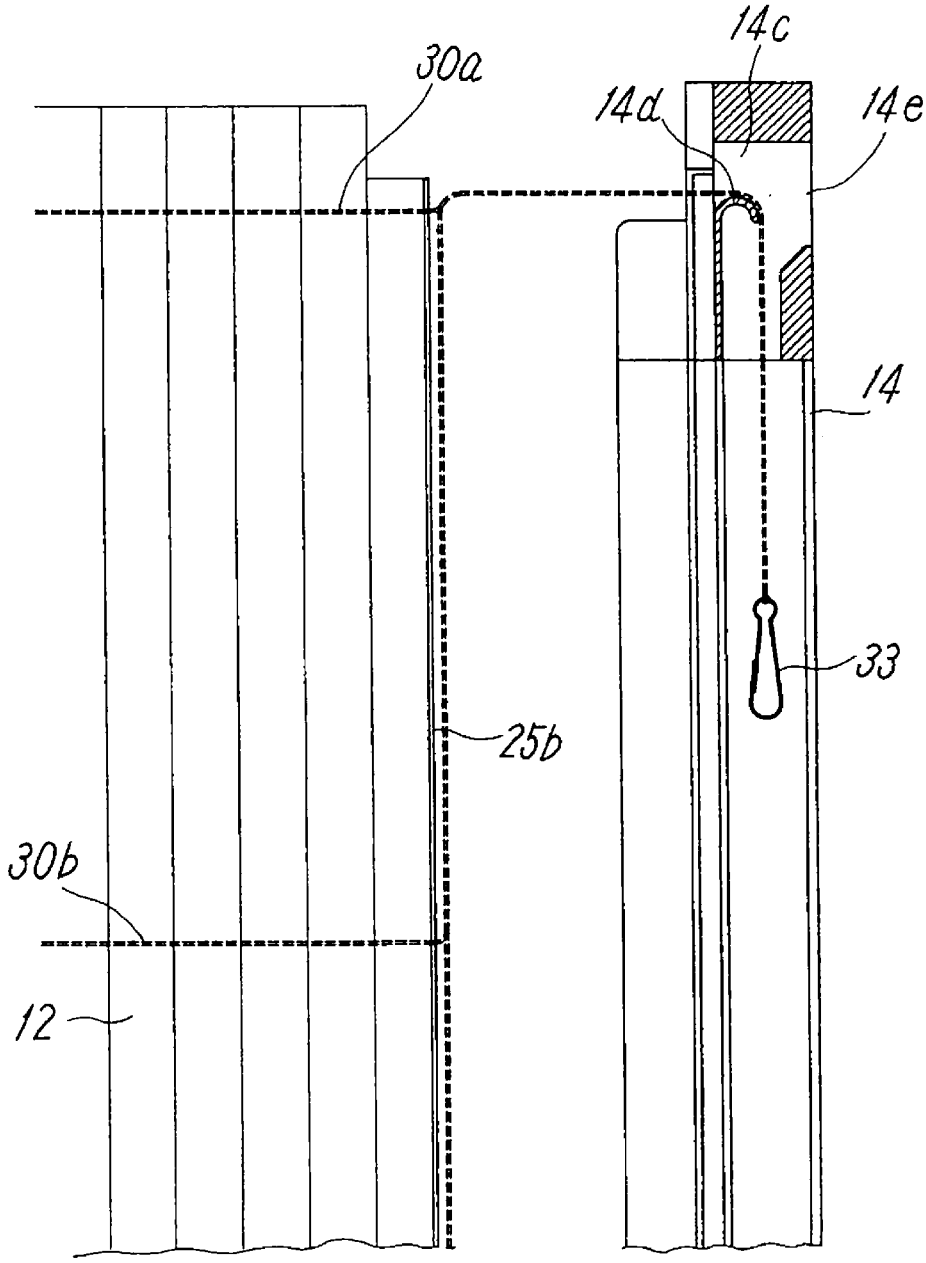
FIG. 10 is a partial front cross-sectional view for explaining a mode of leading wires into the vertical frame member.
Figure 11:
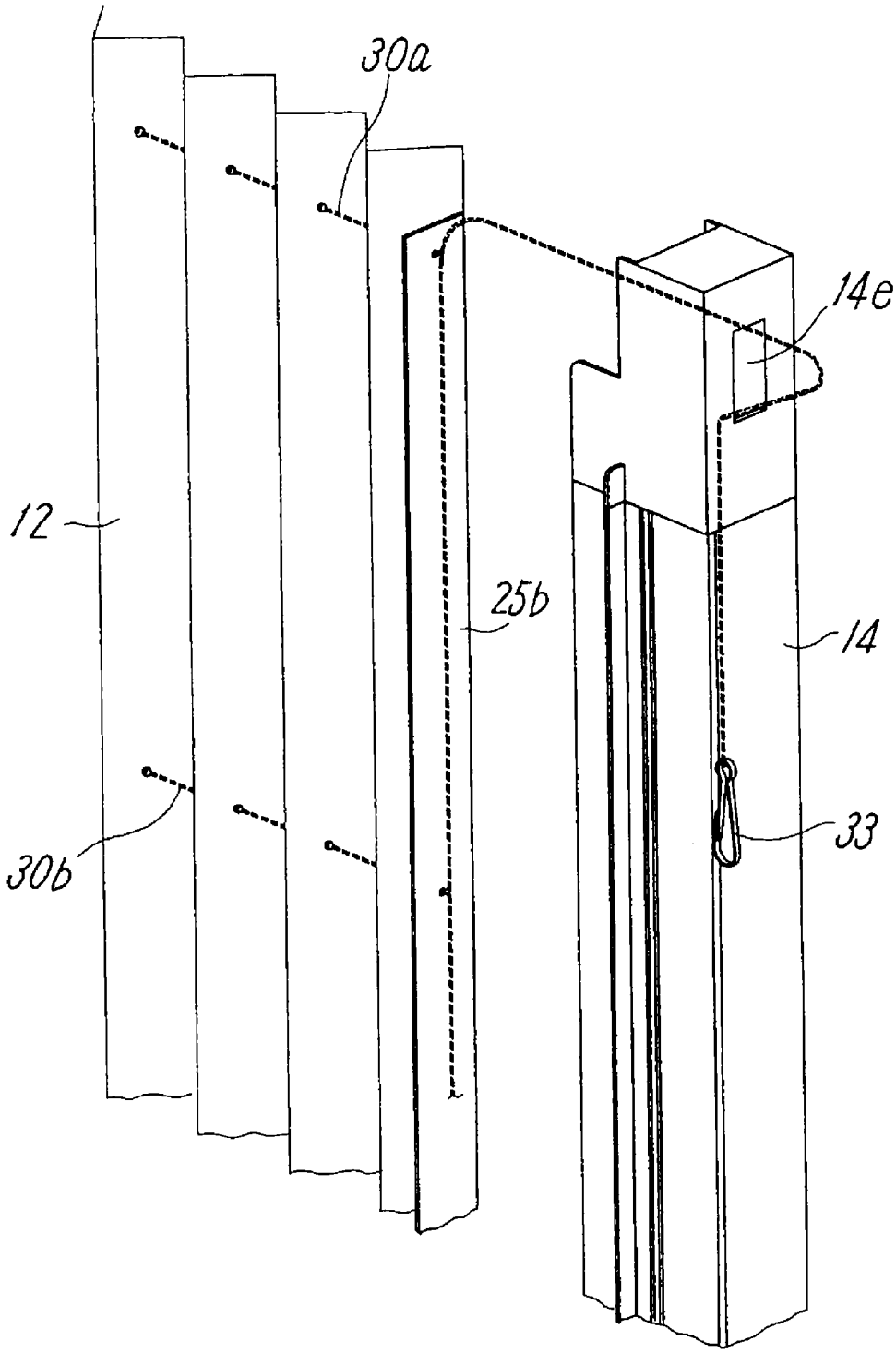
FIG. 11 is a partial front perspective view for explaining a mode of leading wires into the vertical frame member.
Figure 12:
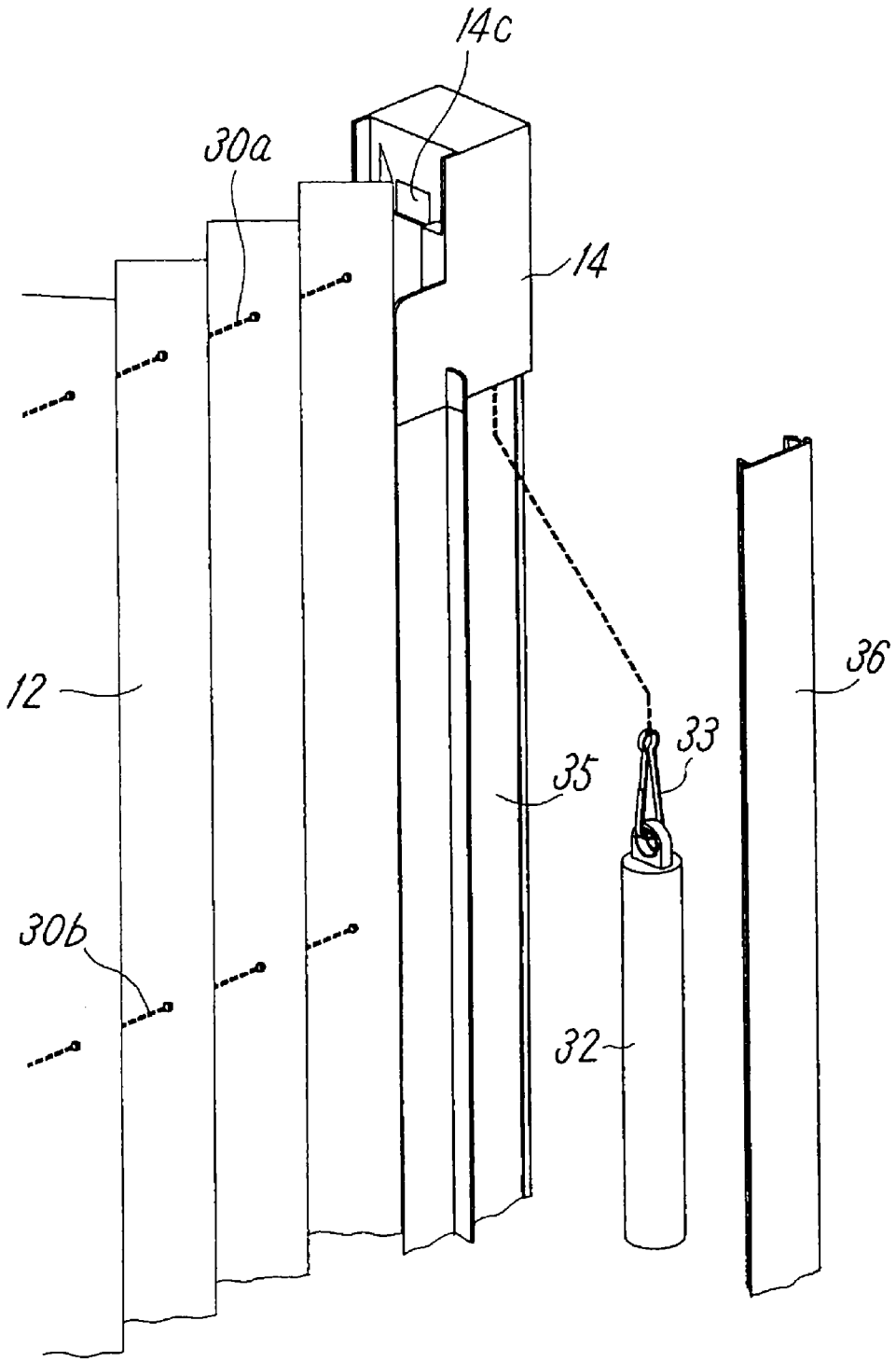
FIG. 12 is a partial perspective view for explaining a mode of attaching and detaching a weight to the distal ends of the wires.
Figure 13:
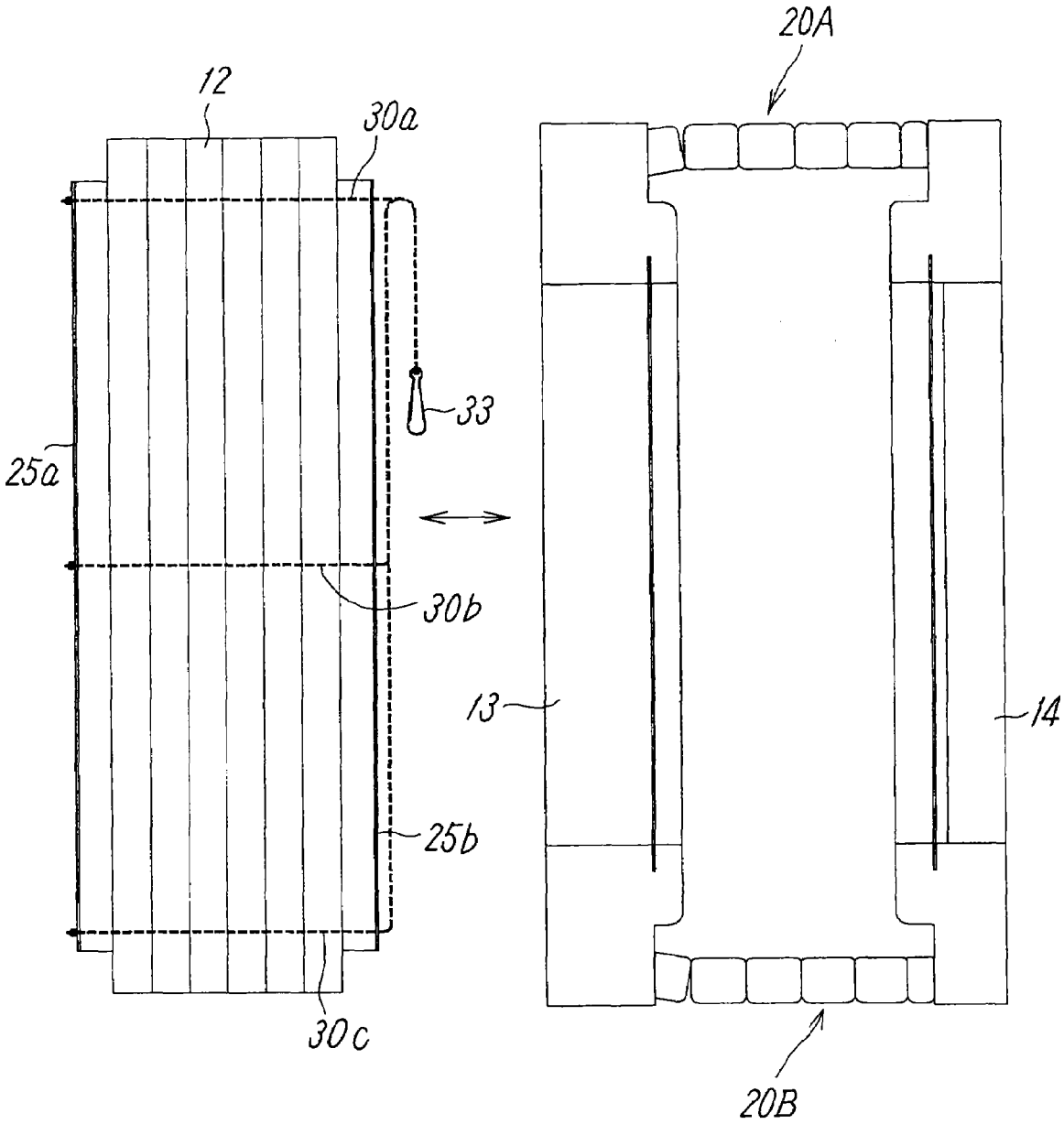
FIG. 13 is an exploded front view for explaining a mode for attaching and detaching a screen through which wires are inserted to/from the vertical frame member and the screen guide.
Figure 14:
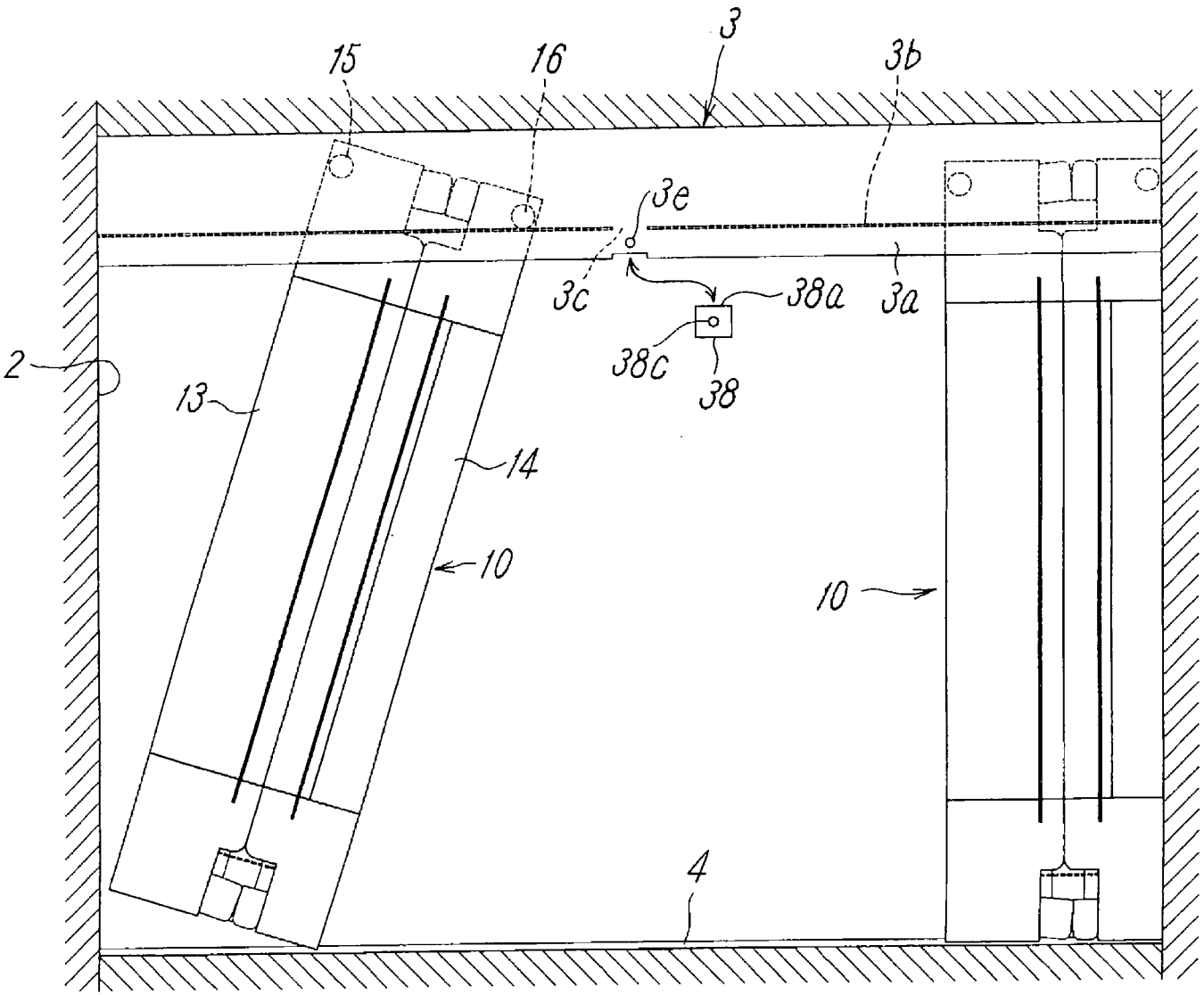
FIG. 14 is a front view for explaining the sequence of detaching a screen unit from the lateral frame member.
Figure 15A:
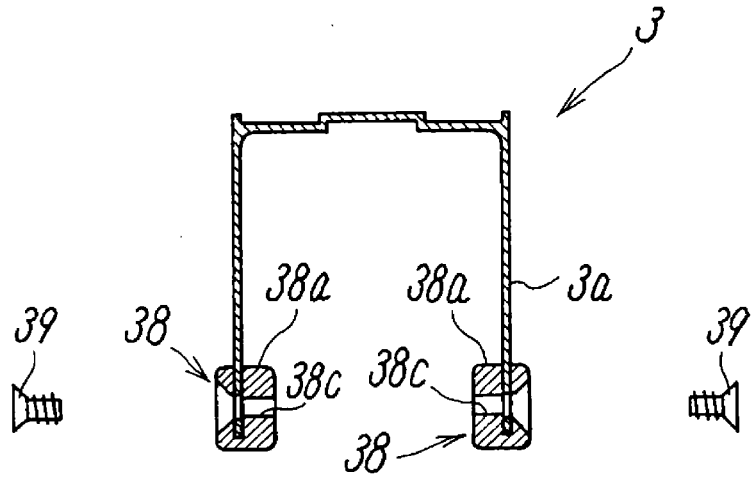
FIG. 15(*a*) is a partial enlarged side cross-sectional view for explaining a mode of detaching caps to the lateral frame member.
Figure 15B:
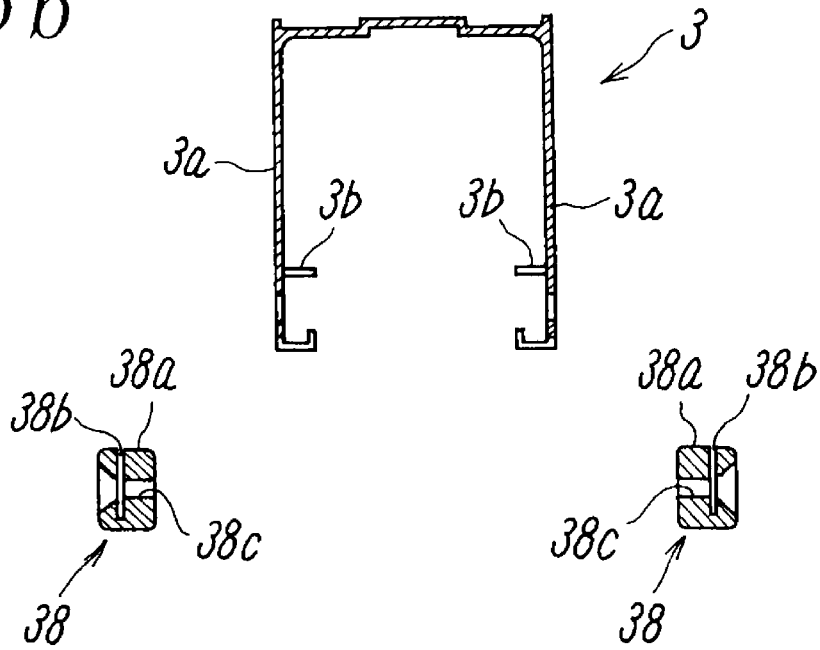
Figure 16:
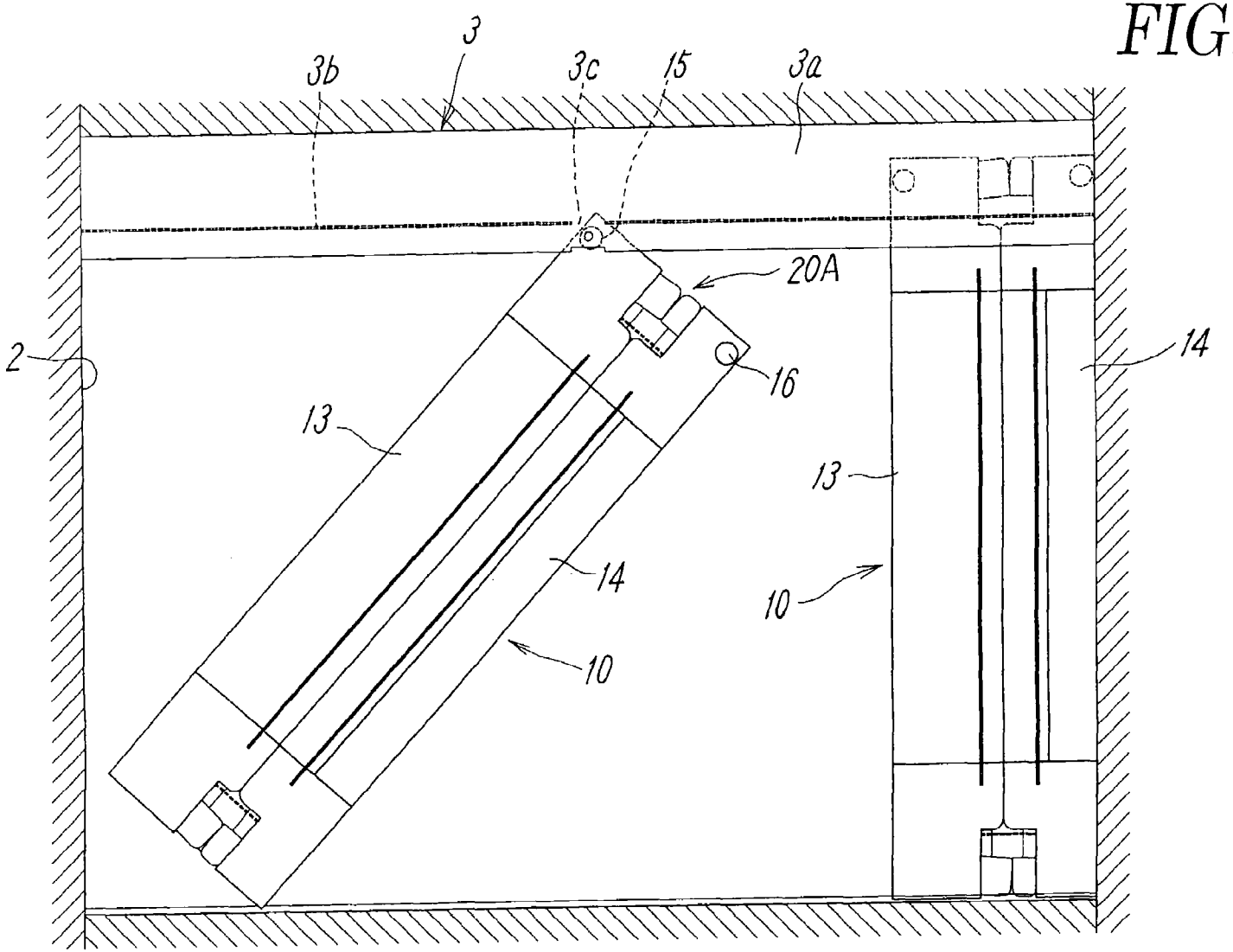
FIG. 16 is a front view for explaining the sequence of detaching the screen unit from the lateral frame member.
Figure 17:
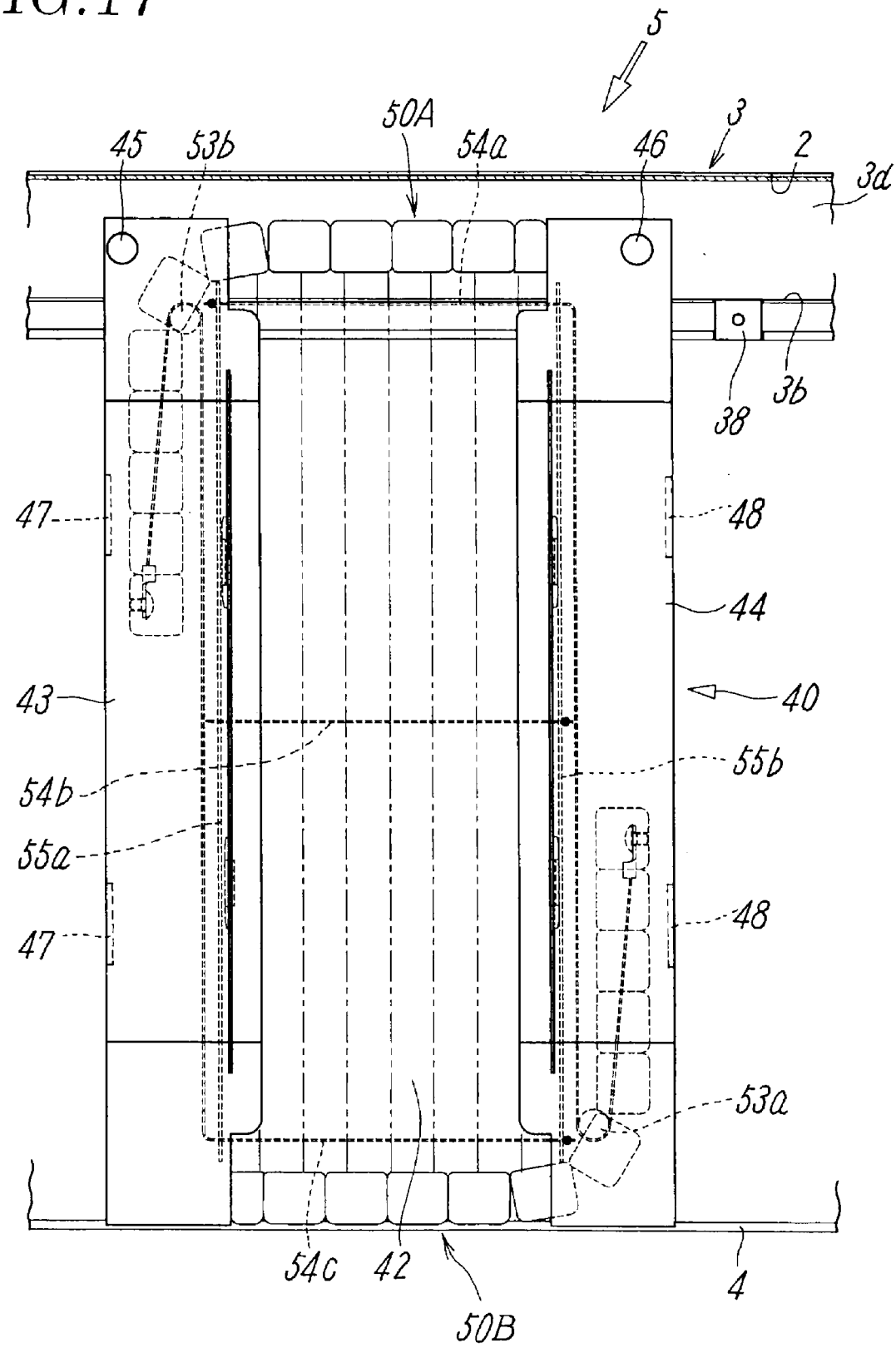
FIG. 17 is a partly broken front view showing a second embodiment of the folding screen device according to the present invention.
Figure 18:
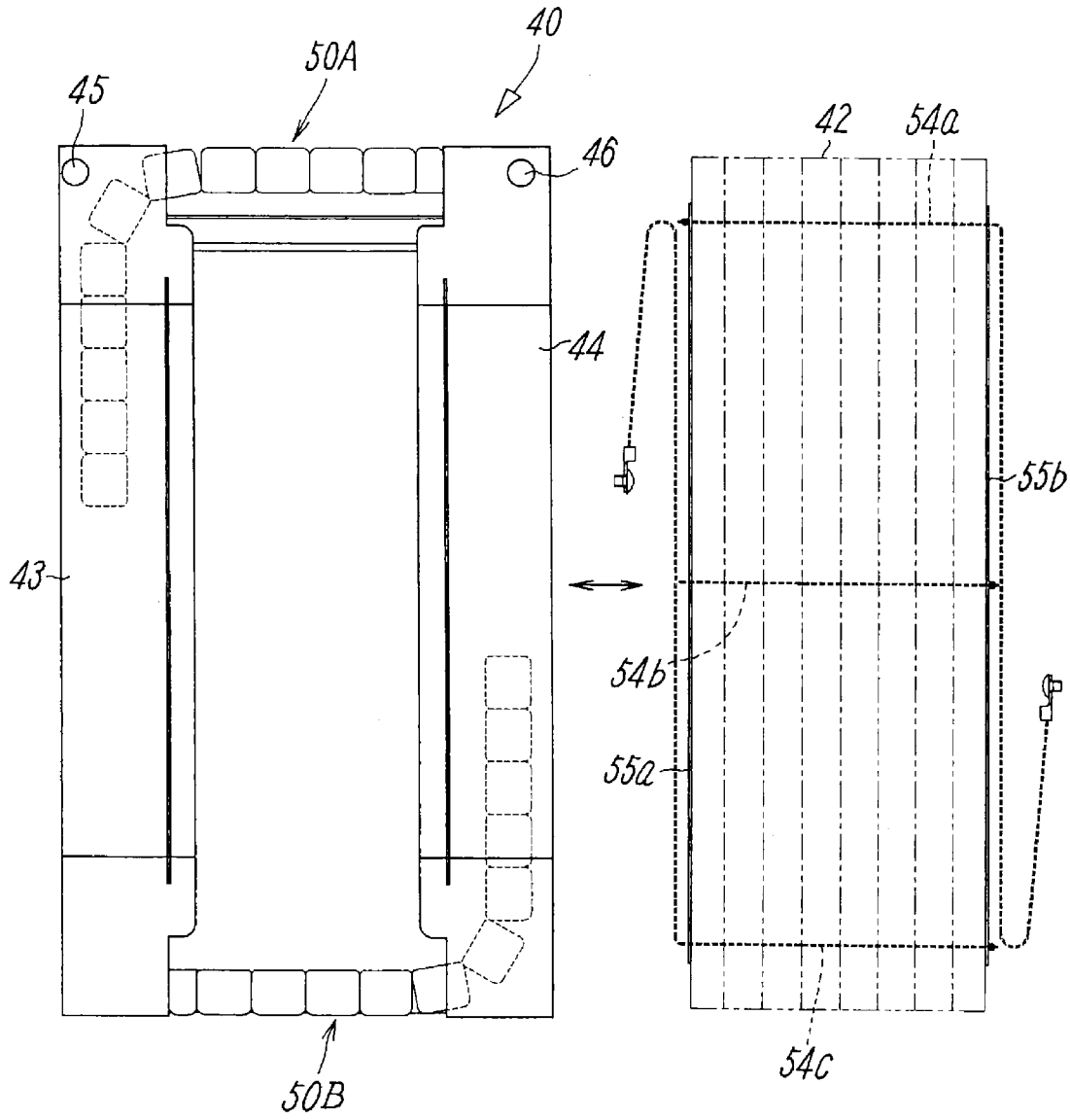
FIG. 18 is an exploded front view for explaining a mode of attaching and detaching the screen through which the wires are inserted to/from the vertical frame member and the screen guide.

1, 5 screen device
2 opening for a building
3 lateral frame member
3*b* rail
3*c* slit
3*d* supporting groove
10, 40 screen unit
12, 42 screen
13, 14, 43, 44 vertical frame members
15, 16, 45, 46 projections
20A, 20B, 50A, 50B screen guides
21 guide piece
24, 54*a*-54*c* wire
25*a*, 25*b*, 55*a*, 55*b* mounting plates
28 mounting member
30*a*-30*c* wire
32 weight
35 operation opening
38 cap

The invention claimed is:

1. A folding screen device comprising:

a lateral frame member which is attached at an upper portion of an opening of a building, and which includes a supporting groove that opens toward a lower side and extends in an axial direction; and a plurality of screen units each including:

a first vertical frame member and a second vertical frame member each having an upper end portion being fitted and held in the supporting groove of the lateral frame member, the first vertical frame member and the second vertical frame member being slidable along the supporting groove;

a screen including a right end and a left end to which the first vertical frame member and the second vertical frame member are attached respectively, which is expandable in an accordion manner by being folded alternately in the opposite direction at a number of bending portions provided in parallel at regular intervals, and which is openable and closable by a sliding movement of the first vertical frame member and the second vertical frame member, wherein upper end portions of a plurality of first vertical frame members and a plurality of second vertical frame members in the plurality of screen units are fitted and held in one identical supporting groove in the lateral frame member so that the plurality of screen units are arranged in parallel in the opening of the building, and wherein bumping surfaces of the first vertical frame member in a first screen unit and the second vertical frame member in an adjacent screen unit are detachably connected to each other;

an upper screen guide and a lower screen guide move out of and into the interior of the first vertical frame member and/or the second vertical frame member in a bent state with an opening and closing operation of the screen, and are led out along an upper end and a lower end of the screen in an extended state for guiding the upper end and the lower end of the screen;

a parallel movement mechanism for maintaining a parallel state between the first vertical frame member and the second vertical frame member during the opening and closing operation of the screen;

a pair of rails extending in an axial direction of the supporting groove, protruding from respective inner surfaces of a pair of pending walls constituting side walls of the supporting groove of the lateral frame member so as to be opposed to each other in a width direction of the supporting groove;

a pair of rollers for preventing the upper end portions of the first vertical frame members and the second vertical frame members from being detached from the supporting grooves by contact with upper surfaces of the rails, protruding from positions above the pair of rails in the upper end portions of the first vertical frame members and the second vertical frame members, the pair of rollers being provided so as to be opposed to each other in the width direction of the supporting groove, wherein each rail of the pair of rails is provided with a slit at an intermediate position in the axial direction of each rail, the slit cutting off each rail from a tip end thereof in the width direction of each rail, penetrating through each rail toward the lower side of the lateral frame member, having an opening length in the axial direction larger than a diameter of the roller, constituting a pair, and dividing each rail of the pair of rails into a plurality of rail parts in the axial direction so that the pair of rollers provided in each of the first vertical frame members and second vertical frame members can be detached from the supporting groove through the pair of slits toward the lower side of the lateral frame member by tilting the first vertical frame member and the second vertical frame member in the axial direction of the supporting groove; and a cap for closing the slit is detachably attached to each slit of the pair of slits, wherein the cap has a surface portion closing the slit at a level flush with upper surfaces of the rail parts adjacent to each other in the axial direction while sandwiching the slit therebetween.

2. The folding screen device according to claim 1, wherein, in the screen unit, first ends of the upper screen guide and the lower screen guide are fixed to an upper end and a lower end, respectively, of the second vertical frame member, and second ends of the upper screen guide and the lower screen guide are provided in the interior of the first vertical frame member through openings at the upper end and the lower end, respectively, of the first vertical frame member so that the upper screen guide and the lower screen guide move out and into the interior of the first vertical frame member through the openings at the upper end and the lower end of the first vertical frame member with the opening and closing operation of the screen, wherein a first mounting plate and a second mounting plate are fixed to a right end and a left end of the screen, respectively, and the first mounting plate and the second mounting plate are disengageably engaged to the first vertical frame member and the second vertical frame member, respectively, wherein the parallel movement mechanism comprises first wires inserted horizontally with respect to the screen and extended in the vertical direction in plurality of rows and a weight suspended by the first wires in a space for accommodating the weight, wherein all of the first wires are extended with respect to the screen unit by fixing first ends of the first wires to the first mounting plate, inserting the first ends horizontally with respect to the screen, then causing the first wires to penetrate through the second mounting plate and to be guided to an upper end portion of the second vertical frame member therein, subsequently causing the first wires to be suspended from the upper end portion into the space for accommodating the weight, and detachably attaching second ends of the first wires to the weight, and wherein a side wall constituting the space for accommodating the weight of the second vertical frame member is provided with an operation opening opened to a side surface of the second vertical frame member for attaching and detaching therethrough the second ends of the first wires with respect to the weight.

3. The folding screen device according to claim 2, wherein the parallel movement mechanism includes a second wire extended in a loop shape in the first vertical frame member, and wherein the second wire is rotatably extended with respect to a pair of redirecting members provided at an upper portion and a lower portion in the first vertical frame member without intersection in a side view, and is connected to the second ends of the upper screen guide and the lower screen guide, and the second wire is connected to the second ends of the upper screen guide and the lower screen guide at respective wire portions between the pair of redirecting members moving in the directions opposite to each other.

4. The folding screen device according to claim 2, wherein the plurality of screen units can be supported by the lateral frame member at the opening of the building, and wherein inhibiting means is provided for inhibiting the screen from being automatically folded by the weight in a state in which the screen is extended.

5. The folding screen device according to claim 1, wherein, in the screen unit, a first end of the upper screen guide is fixed to an upper end of the second vertical frame member, and a second end of the upper screen guide is provided in the interior of the first vertical frame member through an opening at the upper end of the first vertical frame member so that the upper screen guide moves out and into the interior of the first vertical frame member through the opening at the upper end of the first vertical frame member with the opening and closing operation of the screen, wherein a first end of the lower screen guide is fixed to a lower end of the first vertical frame member, and a second end of the lower screen guide is provided in the interior of the second vertical frame member through an opening at the lower end of the second vertical frame member so that the lower screen guide moves out and into the interior of the second vertical frame member through the opening at the lower end of the second vertical frame member with the opening and closing operation of the screen, wherein a first mounting plate and a second mounting plate are fixed to a right end and a left end of the screen, respectively, and the first mounting plate and the second mounting plate are disengageably engaged to the first vertical frame member and the second vertical frame member, respectively, wherein the parallel movement mechanism includes a first wire inserted horizontally with respect to the screen in an upper half region of the screen and a second wire inserted horizontally with respect to the screen in a lower half region of the screen, wherein the first wire is extended with respect to the screen unit by fixing a first end of the first wire to the first mounting plate, inserting the first end horizontally with respect to the screen, then causing the first wire to penetrate through the second mounting plate and to be guided to a lower end portion of the second vertical frame member by redirection toward the lower side therein, subsequently redirecting the first wire toward the upper side at the lower end portion, and detachably fixing a second end of the first wire with respect to a second end of the lower screen guide, and the second wire is extended with respect to the screen unit by fixing a first end of the second wire to the second mounting plate, inserting the first end horizontally with respect to the screen, then causing the second wire to penetrate through the first mounting plate and to be guided to an upper end portion of the first vertical frame member by redirection toward the upper side therein, subsequently redirecting the second wire toward the lower side at the upper end portion, and detachably fixing a second end of the second wire with respect to a second end of the upper screen guide.

6. The folding screen device according to claim 4, wherein the wire to be inserted through the screen and attached with the weight being suspended at the distal end thereof is fixed at one end thereof to the first mounting plate engaged with the first vertical frame member and is detachably attached with the weight at the distal end suspending from the upper end of the second vertical frame member, and wherein the second vertical frame member is provided with an operation opening for attaching and detaching the weight to the distal end of the wire and an insertion path for inserting the wire is configured to facilitate insertion and removal of the wire.

7. The folding screen device according to claim 1, wherein a small hole through which a screw is inserted is extended through a lower end portion of each of the pending walls at a position below the rail, the cap is provided with a cut groove into which a lower edge of the pending wall is fitted and held, and a screw hole which is disposed so as to cross the cut groove at a right angle and into which the screw is threadingly inserted, and the cap is fixed to the pending wall by making the small hole of the pending wall correspond to the screw hole in the cut groove, inserting the screw into the small hole, and screwing the screw into the screw hole.

* * * * *